US010743586B2

(12) United States Patent
Kleizo

(10) Patent No.: US 10,743,586 B2
(45) Date of Patent: Aug. 18, 2020

(54) ELECTRONIC CIGARETTE HAVING REBUILDABLE ATOMIZER DECK (RDA)

(71) Applicant: FAST EDDIE'S VAPE SHOP AND LOUNGE, LLC, Orlando, FL (US)

(72) Inventor: Matthew R. Kleizo, Longwood, FL (US)

(73) Assignee: FAST EDDIE'S VAPE SHOP AND LOUNGE, LLC, Sanford, FL (US)

( * ) Notice: Subject to any disclaimer, the term of this patent is extended or adjusted under 35 U.S.C. 154(b) by 236 days.

(21) Appl. No.: 15/921,926

(22) Filed: Mar. 15, 2018

(65) Prior Publication Data

US 2018/0263285 A1 Sep. 20, 2018

Related U.S. Application Data

(60) Provisional application No. 62/473,713, filed on Mar. 20, 2017.

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2020.01) |

(52) U.S. Cl.
CPC ..... *A24F 47/008* (2013.01); *H05B 2203/021* (2013.01)

(58) Field of Classification Search
CPC ..... A24F 47/008; A24F 47/00
USPC ..... 131/329
See application file for complete search history.

(56) References Cited

U.S. PATENT DOCUMENTS

| | | | | |
|---|---|---|---|---|
| 8,550,068 | B2 | 10/2013 | Terry et al. | |
| 8,820,330 | B2 | 9/2014 | Bellinger et al. | |
| 8,897,628 | B2 | 11/2014 | Conley et al. | |
| 9,854,848 | B1 * | 1/2018 | Servutas | A24F 47/008 |
| 10,357,064 | B1 * | 7/2019 | Kleizo | A61M 21/02 |
| 2014/0041655 | A1 * | 2/2014 | Barron | A61M 11/042 128/202.21 |
| 2014/0332019 | A1 | 11/2014 | Liu | |

(Continued)

FOREIGN PATENT DOCUMENTS

| | | |
|---|---|---|
| CN | 204157653 | 2/2015 |
| CN | 205567822 | 9/2016 |

(Continued)

*Primary Examiner* — Abdulla A Riyami
*Assistant Examiner* — Thang H Nguyen
(74) *Attorney, Agent, or Firm* — Allen, Dyer, Doppelt + Gilchrist, P.A.

(57) ABSTRACT

An electronic cigarette includes a housing. A rebuildable dripping atomizer (RDA) deck on the housing supports first and second spaced terminal posts connected to first ends of respective first and second heating coils. A central column terminal has a central post received within a central orifice of the RDA deck and engages a battery contained in the housing. A transverse support is spaced above the terminal posts and onto which second ends of respective first and second heating coils are clamped. An insulator separates the central post from the RDA deck. A switch is carried by the housing and connected to the electrical circuit and completes the electrical circuit to energize the heating coils and vaporize juice contained on at least one wick held by the heating coils.

28 Claims, 23 Drawing Sheets

(56) References Cited

U.S. PATENT DOCUMENTS

| | | | | |
|---|---|---|---|---|
| 2015/0114410 | A1* | 4/2015 | Doster | A24F 47/008 131/329 |
| 2015/0208729 | A1 | 7/2015 | Monsees et al. | |
| 2015/0245654 | A1 | 9/2015 | Memari et al. | |
| 2016/0174611 | A1 | 6/2016 | Monsees et al. | |
| 2016/0183596 | A1* | 6/2016 | Rado | A24F 47/008 |
| 2016/0366947 | A1 | 12/2016 | Monsees et al. | |
| 2017/0035115 | A1 | 2/2017 | Monsees et al. | |
| 2018/0035721 | A1* | 2/2018 | Cyphert | A24D 3/048 |
| 2018/0049466 | A1* | 2/2018 | Cyphert | A61M 11/003 |

FOREIGN PATENT DOCUMENTS

| | | |
|---|---|---|
| CN | 205658372 | 10/2016 |
| CN | 106235422 | 12/2016 |

* cited by examiner

30

ELECTRONIC CIGARETTE HAVING REBUILDABLE ATOMIZER DECK (RDA)

PRIORITY APPLICATION(S)

This utility patent application is based on U.S. provisional patent application Ser. No. 62/473,713 filed Mar. 20, 2017, the disclosure which is hereby incorporated by reference in its entirety.

FIELD OF THE INVENTION

This invention relates to electronic cigarettes, and more particularly, this invention relates to an electronic cigarette having a rebuildable atomizer deck (RDA).

BACKGROUND OF THE INVENTION

Electronic cigarettes have become very popular in the last few years. Many of these electronic cigarettes operate as a battery-powered vaporizer that includes a mouth piece, a rebuidable device or deck, a juice or e-liquid that is vaporized and a heating element or similar atomizer. The heating element is typically a heating coil and heats and vaporizes the juice. A wicking material helps draw the juice or liquid onto the coil such as from a well that holds the juice. In some devices, the user manually depresses a button on the side of the housing or at the end of the device to close a switch and actuate a contact button or "firing pin" or other contact device to complete the electronic circuit between the battery and the atomizer.

The electronic cigarette designs currently in use vary and recent design modifications include mechanical "mods," for example, that may have a rebuildable atomizer deck that allows a user to assemble or "build" the wick and coil themselves, instead of using off-the-shelf atomizer "heads." These types of devices are often termed a rebuildable dripping atomizer (RDA), or sometimes referred to as a "dripper." Experienced users of electronic cigarettes enjoy building their atomizers because they can choose a specific configuration and electrical resistance of their coil, and thus, pick their flavor and the amount of aerosolized vapor produced by the electronic cigarette. In the rebuidable dripping atomizer, the juice is usually dripped directly onto the coil and the wick. The liquid or juice used in these systems generally has vegetable glycerin or propylene glycol and may include flavoring. The RDA "building deck" or "deck" usually has two or three or more posts with holes formed in them that accept one or more coils. The user typically maintains the wick wet by dripping liquid onto the bare wick and coil and/or drawing juice from a well. Often a well-built RDA will last as many as 10 to 20 puffs and emit very large quantities of vapor.

When rebuilding the RDA decks, there is usually a positive post in the center and one or more negative posts located outside the center. One end or lead of the coil is attached to the positive post and the other lead of the coil is attached to one of the negative posts. This process is repeated on opposing sides if two coils are used. In some devices, air flow control can be maintained by spinning a top piece to close off the air holes or open them wide. The number of holes can vary so that the atomizer is used efficiently with one or two or more coils and the holes are lined up adjacent the coils. With a single coil, the RDA operates in a single coil mode, but with two coils, the RDA operates in a dual coil mode.

Building the coils typically requires a user to select the type of wire and its gauge. In one example, the user wraps the wire around a cylindrical object to form the coil and then inserts the coil within the negative or positive leads in order to make a "build." Often the device configuration does not permit an efficient electrical connection and makes the build difficult. Some designs are even clumsy to use after the build.

SUMMARY OF THE INVENTION

In a new design, a more efficient RDA subassembly allows an easier "build" and facilitates electrical connection of the heating coils and other components, while maximizing the available volume of juice storage in a well of the RDA deck. Also, an improved housing configuration having male and female tubes facilitates efficient operator use with a button assembly. The use of male and female tubes permits different through-holes to expose ornamental features by creating a secondary layer that allows additional ornamental features or colors to be added and provide a higher level of decorative aesthetic appeal when compared to other devices. The button assembly may include a base, button screw member, and intermediate ring member.

The electronic cigarette comprises a housing configured to hold a battery and a rebuildable dripping atomizer (RDA) deck formed of a conductive material and supported by the housing. It is configured to support one or more heating coils, and in an example, first and second heating coils. It has a central orifice and first and second spaced terminal posts configured to connect to first ends of respective first and second heating coils. A central column terminal as a T-terminal comprises a central post received within the central orifice of the RDA deck and engages the battery. A transverse support is carried by the central post and spaced above the terminal posts, and thus, in-line and onto which second ends of respective first and second heating coils are positioned. A clamp bar is secured onto the transverse support and fixes the second ends of the heating coils in place on the transverse support. An insulator as a sleeve is received within the central orifice of the RDA deck and insulates electrically the central post from the RDA deck. An electrical circuit connects the battery and RDA deck. A switch as a button assembly, or also referred to as a bottom housing button subassembly, is carried by the housing and connected to the electrical circuit. When closed, the switch completes the electrical circuit and energizes the heating coils to vaporize juice contained on at least one wick held by the heating coils.

The RDA deck may further comprise a recessed well below the coils and terminal posts to hold juice. The central post may further comprise a contact screw that engages the battery and is adjustable relative to the RDA deck and battery to ensure electrical contact between the two. An insulator as a sleeve ring may receive the contact screw to insulate electrically the contact screw from the RDA deck.

The first and second spaced terminal posts are negative in polarity and the central column terminal is positive in polarity in an example. Set screws may secure the first ends of the heating coils onto the respective terminal posts and clamp screws may secure the clamp bar to the transverse support. In another example, the housing is cylindrically configured and includes first and second ends. The RDA deck is supported at the first end and the switch is supported at the second end. The switch may comprise a button assembly having a button and firing pin or other manually actuated mechanism for completing the electrical circuit when the button is depressed.

The button assembly may further comprise a base member having a threaded extension adapted to cooperate with the firing pin mechanism and a threaded orifice. A button screw member includes a head having a predetermined configuration such as an oval or other configuration, such as a butterfly configuration, and a threaded shaft extending therefrom and received into the threaded orifice in the base member. An intermediate ring member is interposed between the base member and the button screw member and includes a slot having a configuration to match and receive the head of the button screw member. For example, if the button screw member has a head that is an oval configuration, then the slot will be oval configured to receive the head of the button screw member. In an example, the base member and button screw member are formed of a metallic material and the intermediate ring member is formed from a plastic material.

The housing may comprise a male and female tube. The female tube may have holes that are configured to expose portions of the male tube received therein. The RDA deck is cylindrically configured and has an outer surface and includes at least one O-ring supported on the outer surface to retain a RDA cap and drip tip received over the RDA deck. The transverse support may include a compression slot into which the second ends of the heating coils are received.

In yet another example, an electronic cigarette comprises a cylindrically configured housing formed from a conductive material and having first and second ends and configured to hold a battery having a positive pole adjacent the first end of the housing and a negative pole adjacent the second end of the housing. A cylindrically configured rebuildable dripping atomizer (RDA) deck is formed from a conductive material and supported at the first end of the housing and configured to support first and second heating coils. It has a central orifice and first and second spaced terminal posts configured to connect to first ends of respective first and second heating coils. A central column terminal comprises a central post received within the central orifice of the RDA deck that engages the positive pole of the battery held within the housing. A transverse support is carried by the central post and spaced above the terminal posts onto which second ends of respective first and second heating coils are positioned. A clamp bar is secured onto the transverse support and fixes the second ends of the heating coils in place on the transverse support. A sleeve is formed of an insulator material and is received within the central orifice of the RDA deck and has an orifice that receives the central post and insulates electrically the central post from the RDA deck. A switch is at the second end of the housing, and when closed, the switch completes an electrical circuit from the negative pole of the battery through the housing to the RDA deck and energizes the heating coils to vaporize juice contained on at least one wick held by the heating coils. The switch may further comprise a button assembly having a button and firing pin mechanism for completing the electrical circuit when the button is depressed. The RDA deck may further comprise a cylindrically configured recessed well to hold juice.

A rebuidable dripping atomizer (RDA) apparatus includes a cylindrically configured RDA deck formed of a conductive material and having a threaded protrusion configured to connect to an electronic cigarette housing. The RDA deck has a central orifice and first and second spaced terminal posts configured to connect to first ends of respective first and second heating coils and a cylindrically configured, recessed well to hold juice. A central column terminal includes a central post received within the central orifice of the RDA deck and configured to engage a battery held within an electronic cigarette housing to which the RDA deck is connected. A transverse support is carried by the central post and spaced above the terminal posts onto which second ends of respective first and second heating coils are positioned. A clamp bar is secured onto the transverse support and fixes the second ends of the heating coils in place on the transverse support. A sleeve is formed of an insulator material and received within the central orifice of the RDA deck and has an orifice that receives the central post and electrically insulates the central post from the RDA deck.

DESCRIPTION OF THE DRAWINGS

Other objects, features and advantages of the present invention will become apparent from the detailed description of the invention, which follows when considered in light of the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to FIGS. 1-4, there is illustrated the assembled electronic cigarette generally at 30 that includes three major subassemblies as the rebuildable dripping atomizer (RDA) subassembly shown generally at 32, a housing subassembly referred to also as the housing and generally indicated at 34 and formed from male and female tubes 36, 38, and a bottom housing button subassembly indicated generally at 40, also referred to as the button assembly and operative as a switch such as by depressing a button. The button assembly 40 as a switch is a common component in many electronic cigarettes and completes the electrical circuit for operating the electronic cigarette and its functionality is explained in further detail below.

Figure 1:
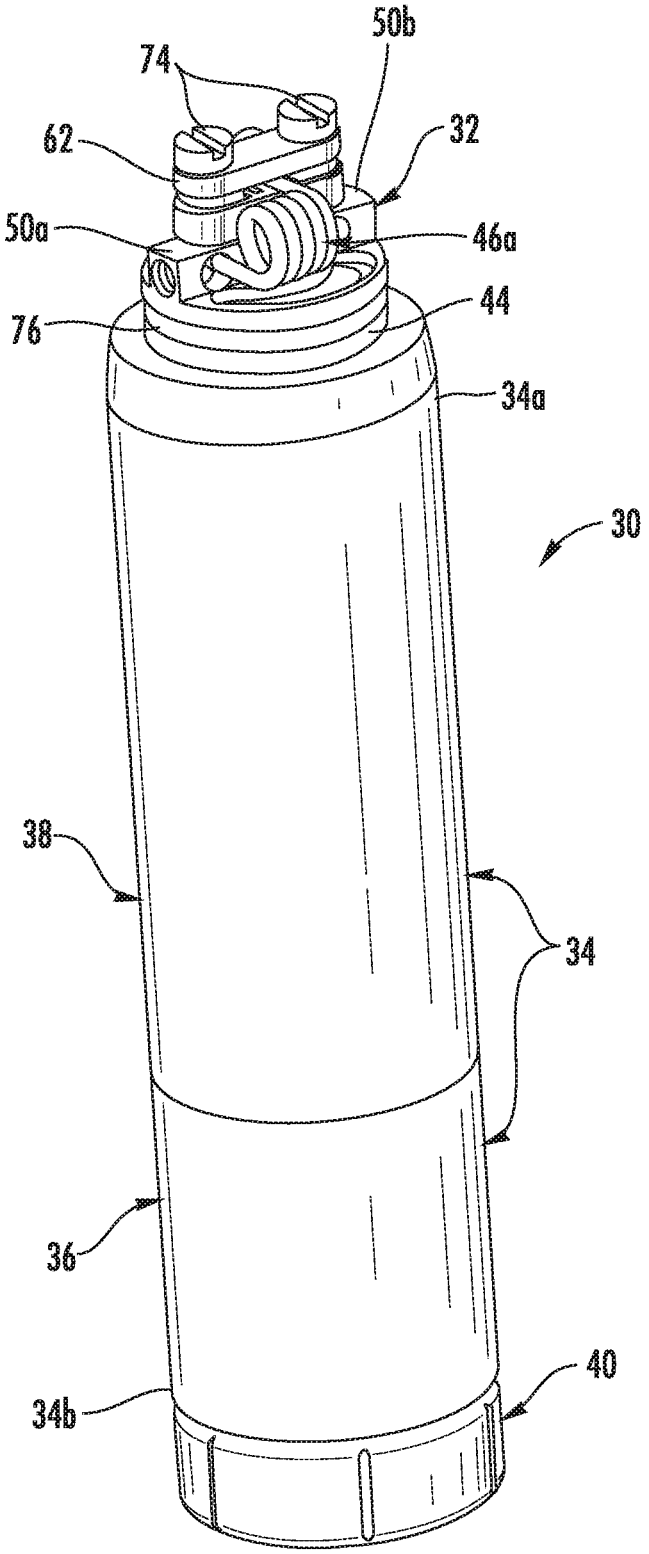
FIG. 1 is an isometric view of the electronic cigarette showing the RDA subassembly on the housing formed by the male and female tubes and the button assembly as a switch in accordance with a non-limiting example.
Figure 2:
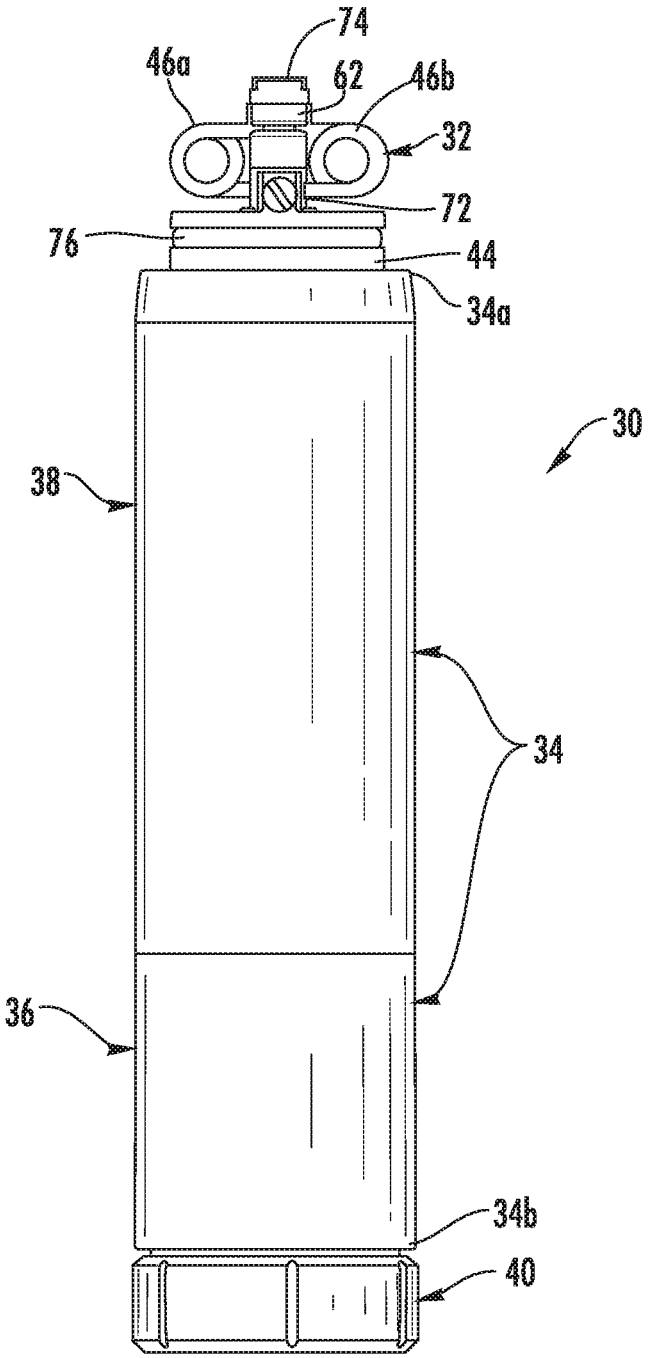
FIG. 2 is a front elevation view of the electronic cigarette of FIG. 1.
Figure 3:
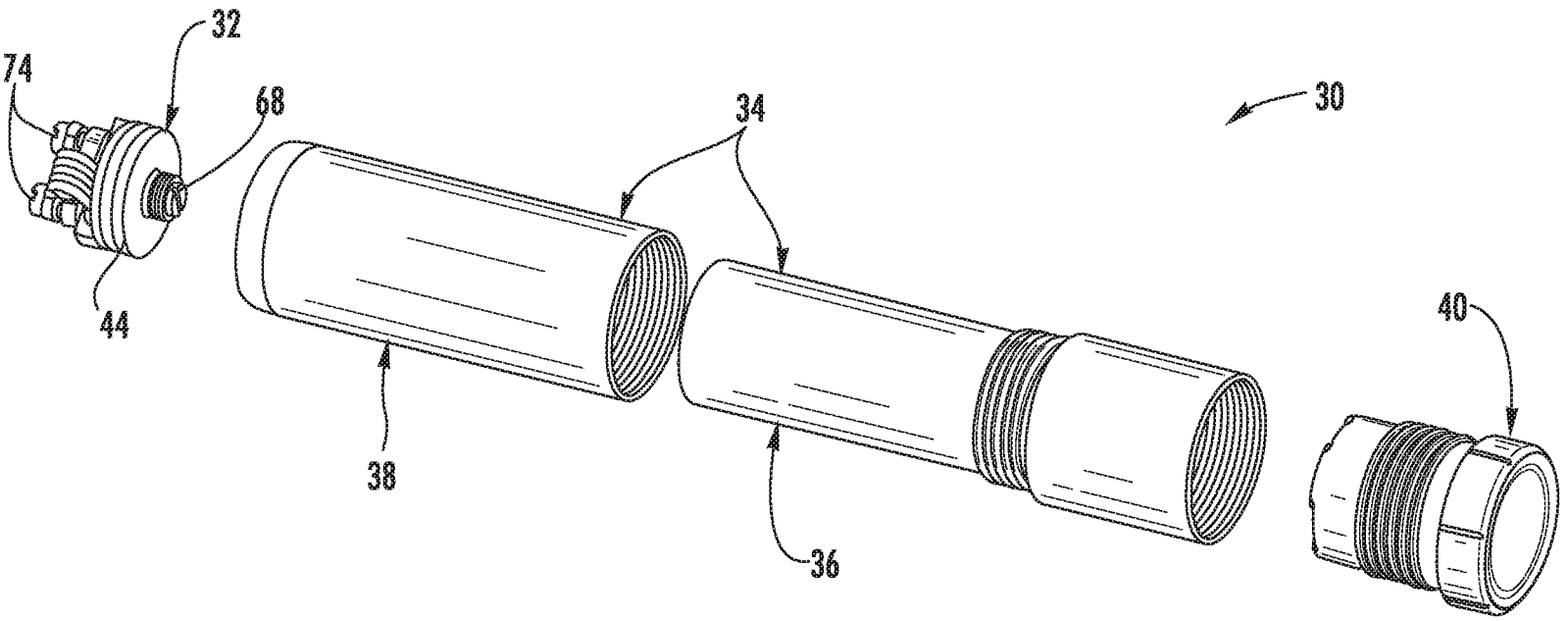
FIG. 3 is an exploded isometric view of the electronic cigarette of FIG. 1 showing the RDA subassembly, the male and female tubes, and the button assembly.
Figure 4:
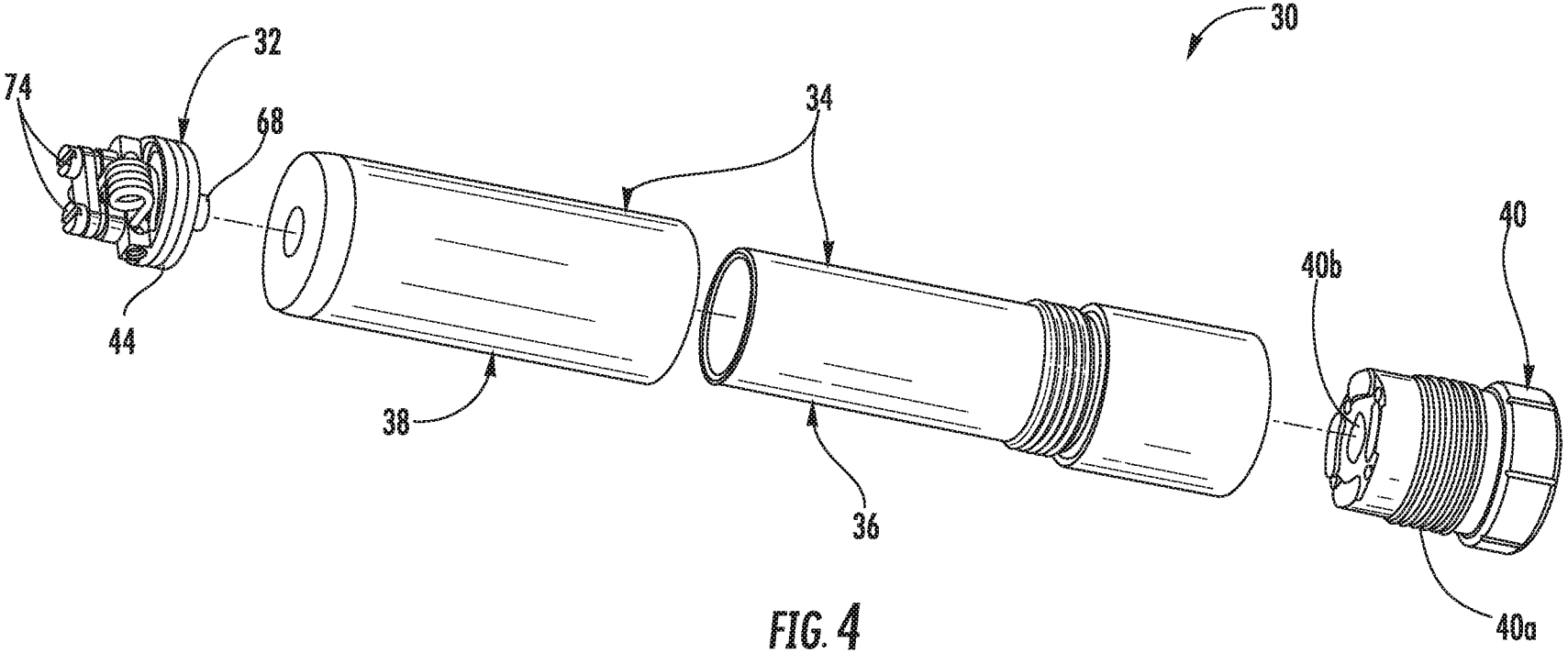
FIG. 4 is yet another exploded isometric view of the electronic cigarette shown at a different angle from that of FIG. 3.
Figure 5:
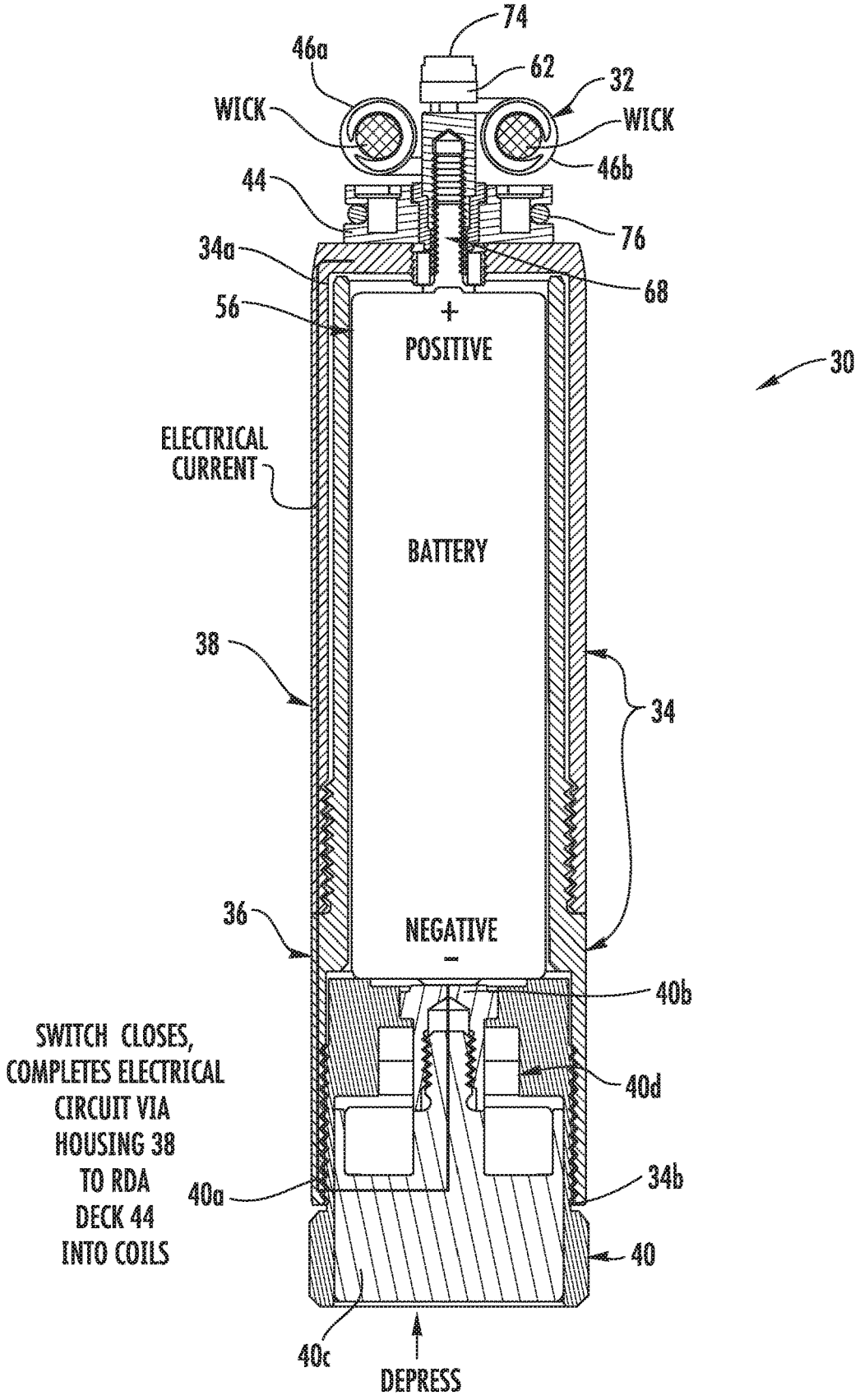
FIG. 5 is a front sectional view of the electronic cigarette of FIG. 1 showing in greater detail the RDA subassembly, male and female tubes, battery and schematic representation of components in the button assembly.
Figure 6:
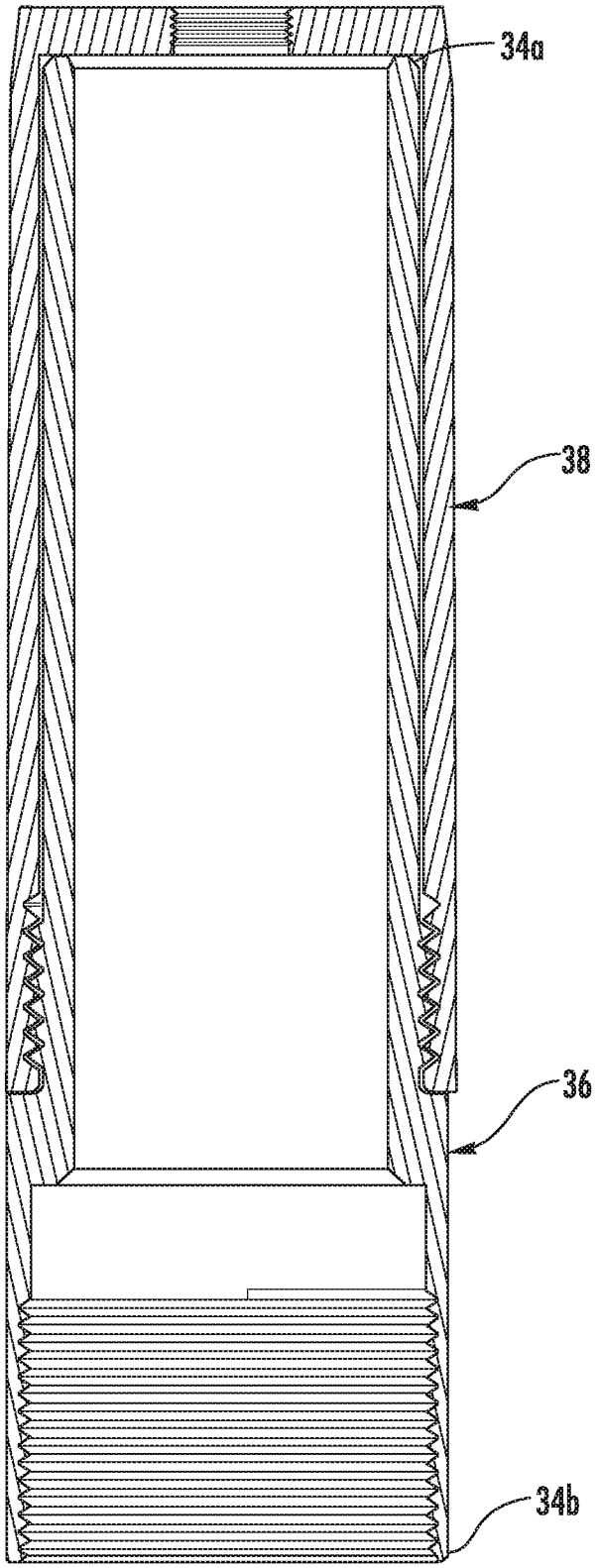
FIG. 6 is a side sectional view of the assembled male and female tubes.
Figure 7:
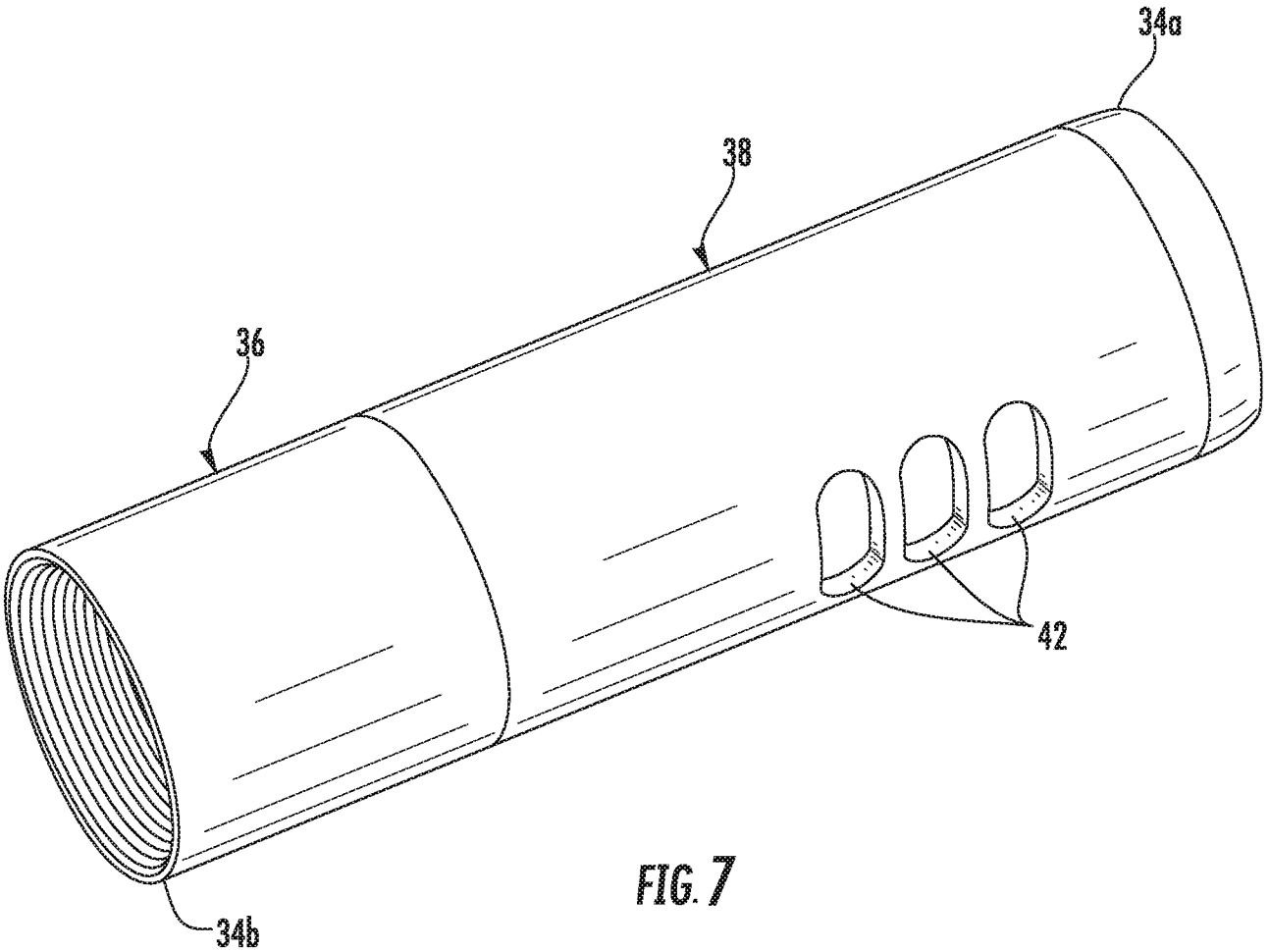
FIG. 7 is an isometric view of the assembled male and female tubes and showing a plurality of through-holes in the female tube to expose ornamental features that may be placed on the male tube.
Figure 8:
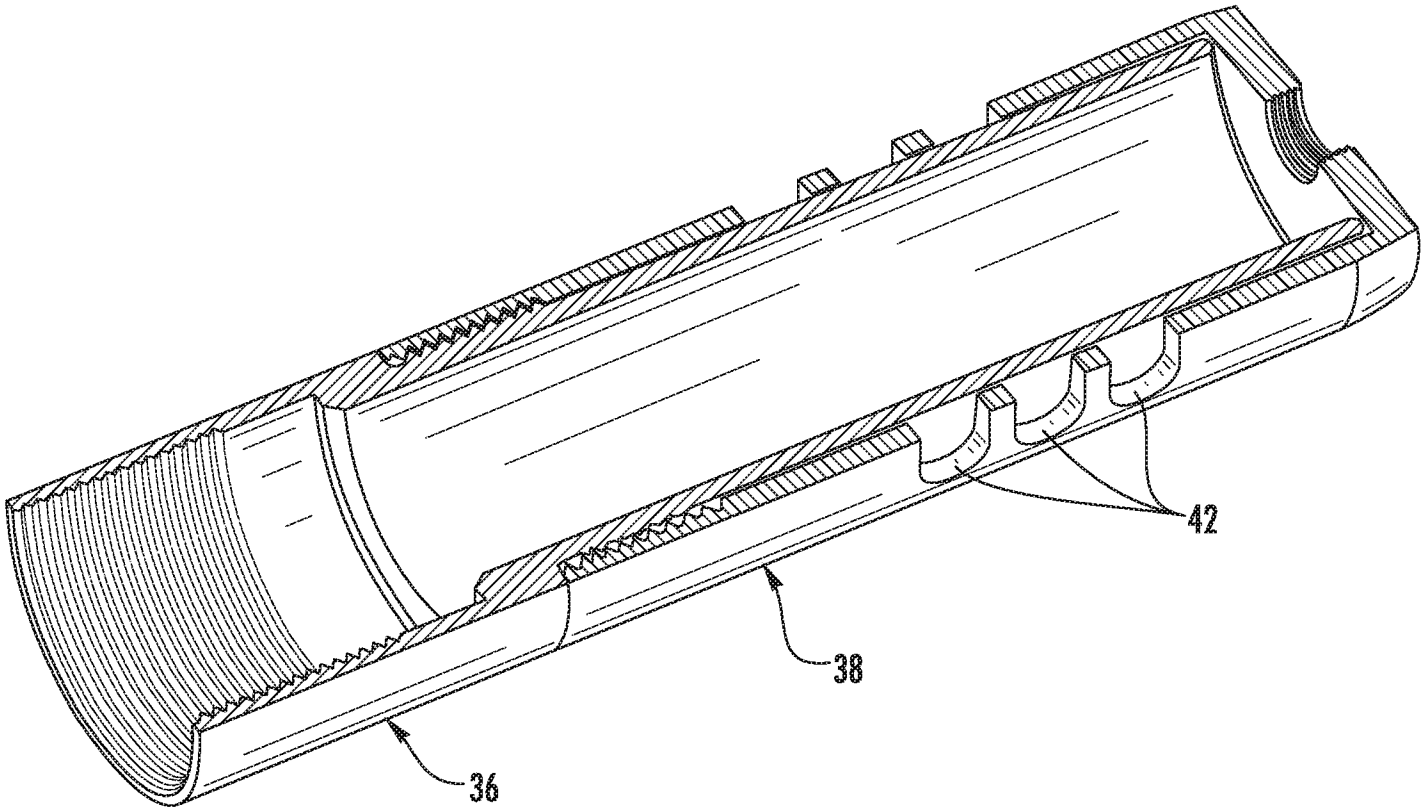
FIG. 8 is a cut-away isometric view of the assembled male and female tubes of FIG. 7.

Referring also now to FIGS. 5-8 in addition to FIGS. 1-4, further details of the housing 34 and its construction are shown. As shown in FIG. 5, the housing 34 is cylindrically configured as a tube and formed of a conductive material such as brass, stainless steel, copper, or other metallic material, and has first and second ends 34*a*, 34*b* and configured to hold a battery having a positive pole adjacent the first end of the housing near the RDA subassembly 32 and a negative pole adjacent the second end of the housing where the button assembly 40 is located. In this embodiment, the housing 34 includes the male and female tubes 36, 38. In a unique design as an example, the female tube 38 has through-holes or orifices 42 (FIGS. 7 and 8) configured to expose portions of the male tube 36 so that ornamental effects located on the male tube can be seen through the orifices of the female tube. Also, the configuration of the holes may add to the ornamental appearance and have other functionality. Thus, a wide variety of ornamental features in the form of orifices or through-holes 42 may be added to the body of the female tube 38 to expose ornamental features on the male tube 36. The combination of features between the male and female tubes creates a secondary layer that is otherwise obscured. Additional ornamental features or colors may be added to provide a higher level of decorative aesthetic features.

As illustrated, the button assembly 40 includes a threaded portion 40*a* (FIGS. 3, 4 and 5) that is received within a threaded portion of the male tube member and has an end with what some skilled in the art refer to as the first button or firing pin 40*b* or other button mechanism that is actuated when a button member 40*c* (FIG. 5) is depressed to complete the circuit in this example. This button assembly 40 in this example includes a solid piece that includes the button member 40*c* that may be pushed manually by depressing with a finger, such as the pinky. It may have two magnets that are polarized to each other and causes a spring to move for the firing mechanism to complete the electrical circuit and heat the heating coil. The magnets and spring may be positioned in the area shown schematically in FIG. 5 at 40*d* to illustrate this type of mechanism. However, in one example, the button 40*c* is depressed, which moves an extension as the "firing pin" 40*b* into the negative part of the battery in yet another example.

Figure 10:
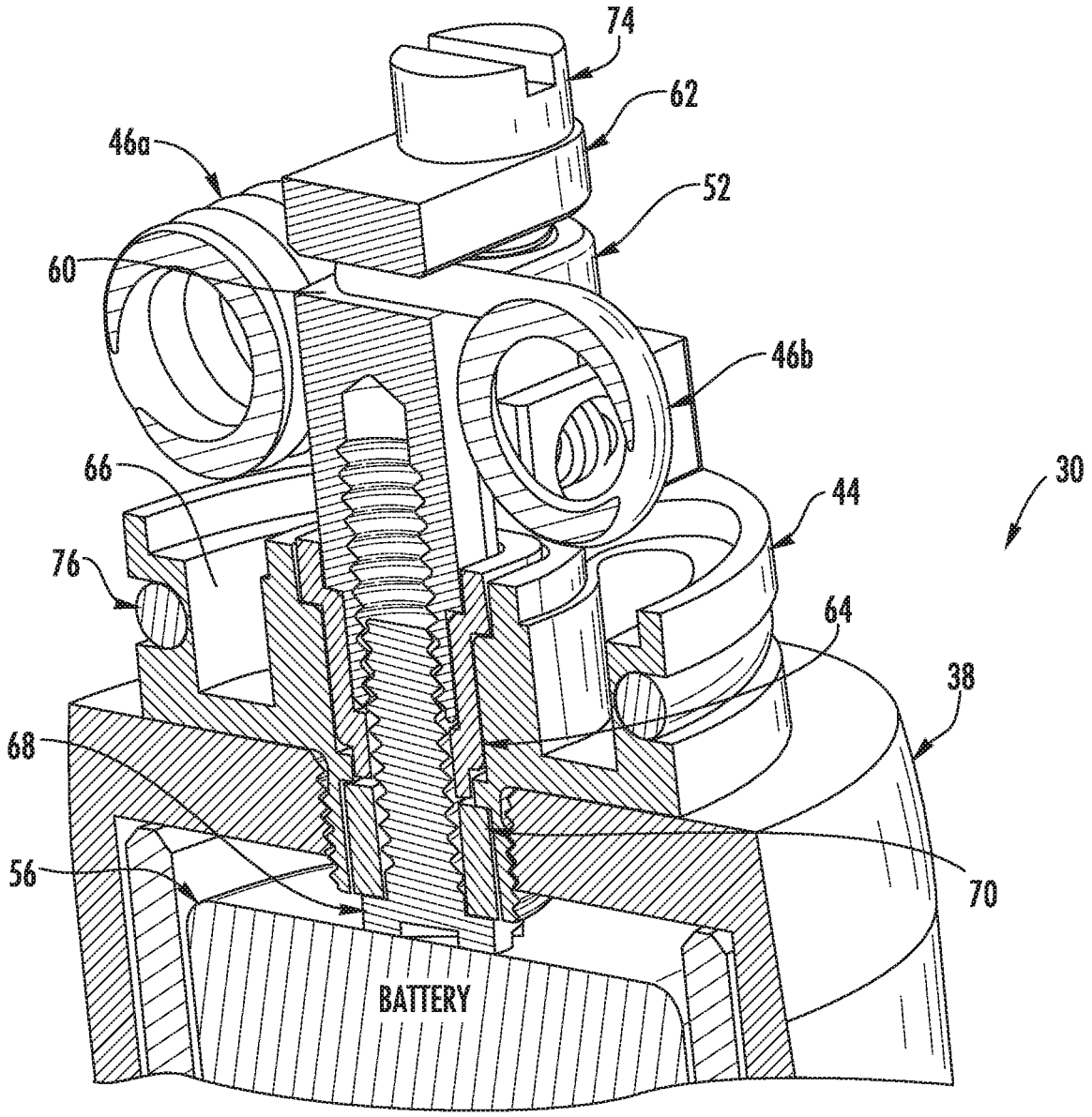
FIG. 10 is a cut-away front isometric view of the electronic cigarette and RDA subassembly of FIG. 9.
Figure 11:
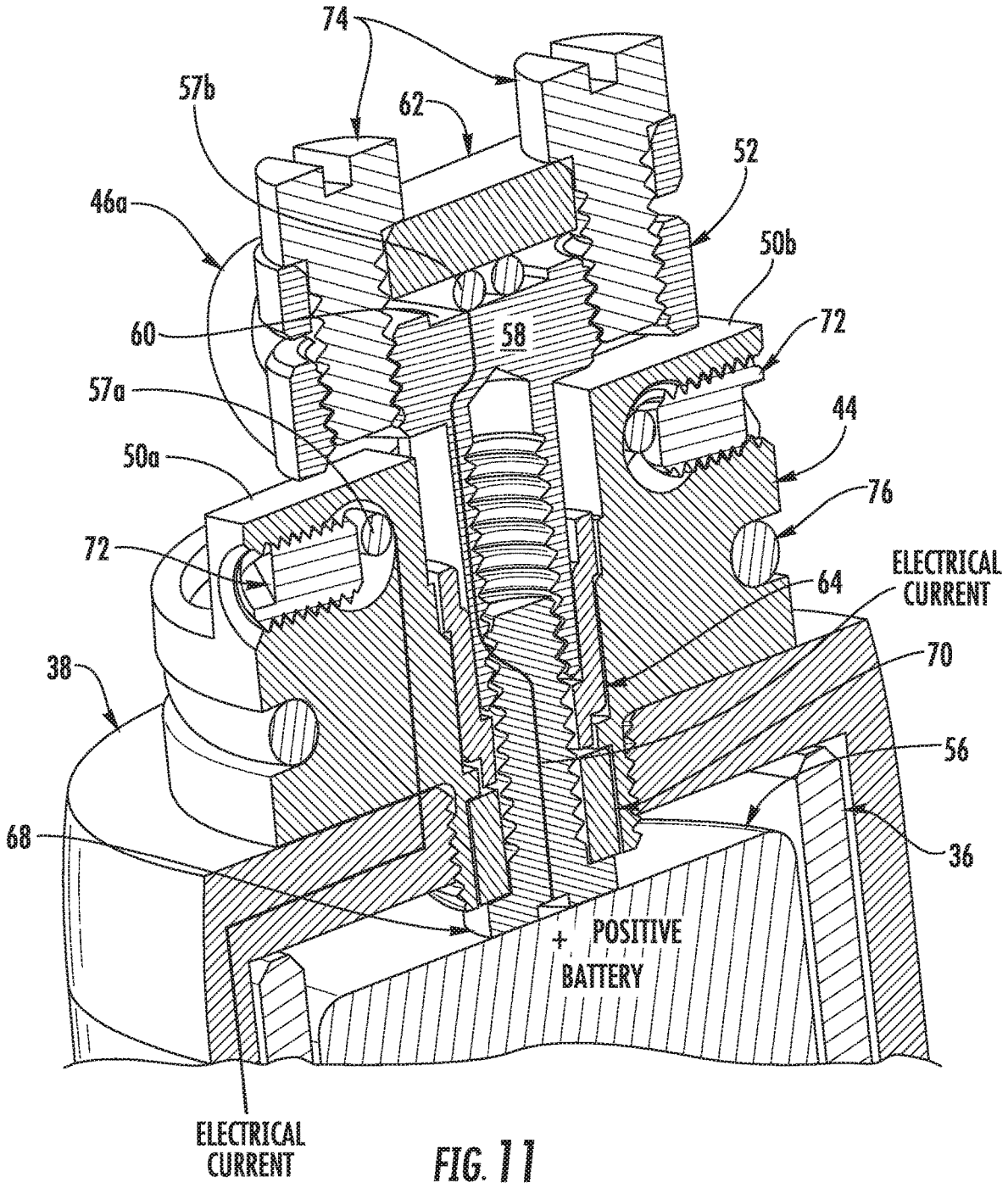
FIG. 11 is cut-away side isometric view of the electronic cigarette and RDA subassembly of FIG. 9 taken 90 degrees from that direction shown in FIG. 10.
Figure 12:
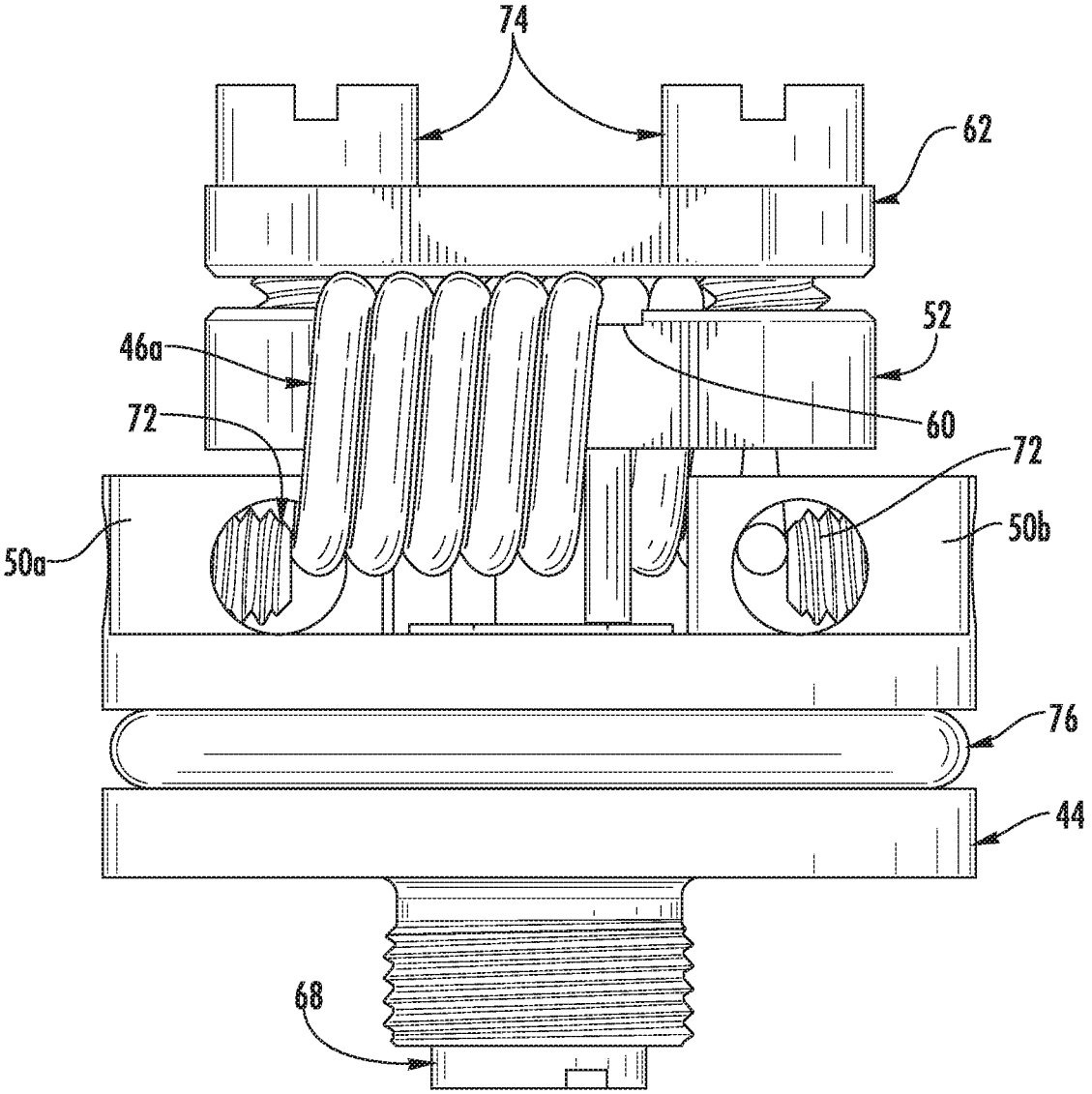
FIG. 12 is a side elevation view of the RDA subassembly.
Figure 13:
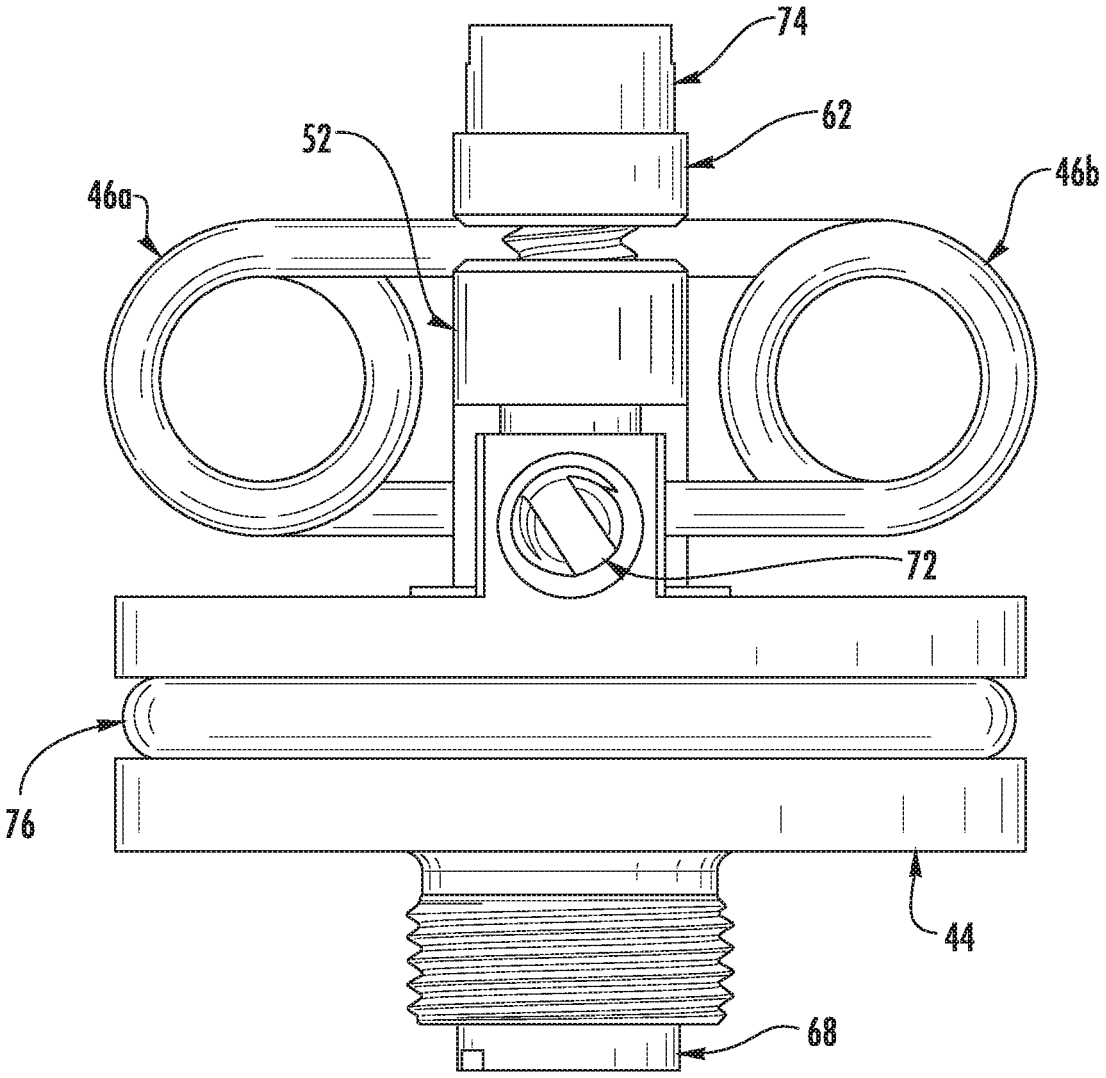
FIG. 13 is a front elevation view of the RDA subassembly.
Figure 14:
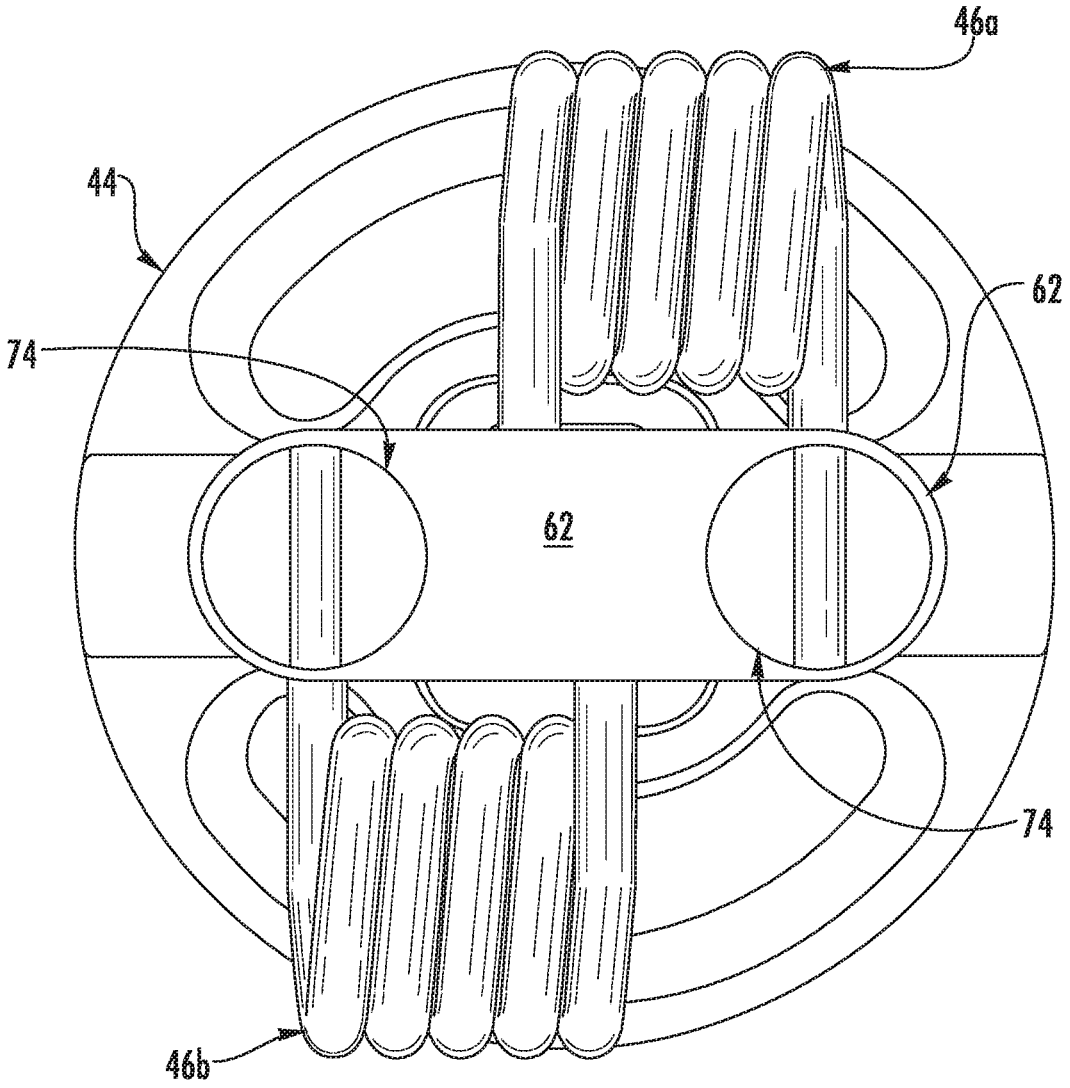
FIG. 14 is a top plan view of the RDA subassembly.
Figure 15:
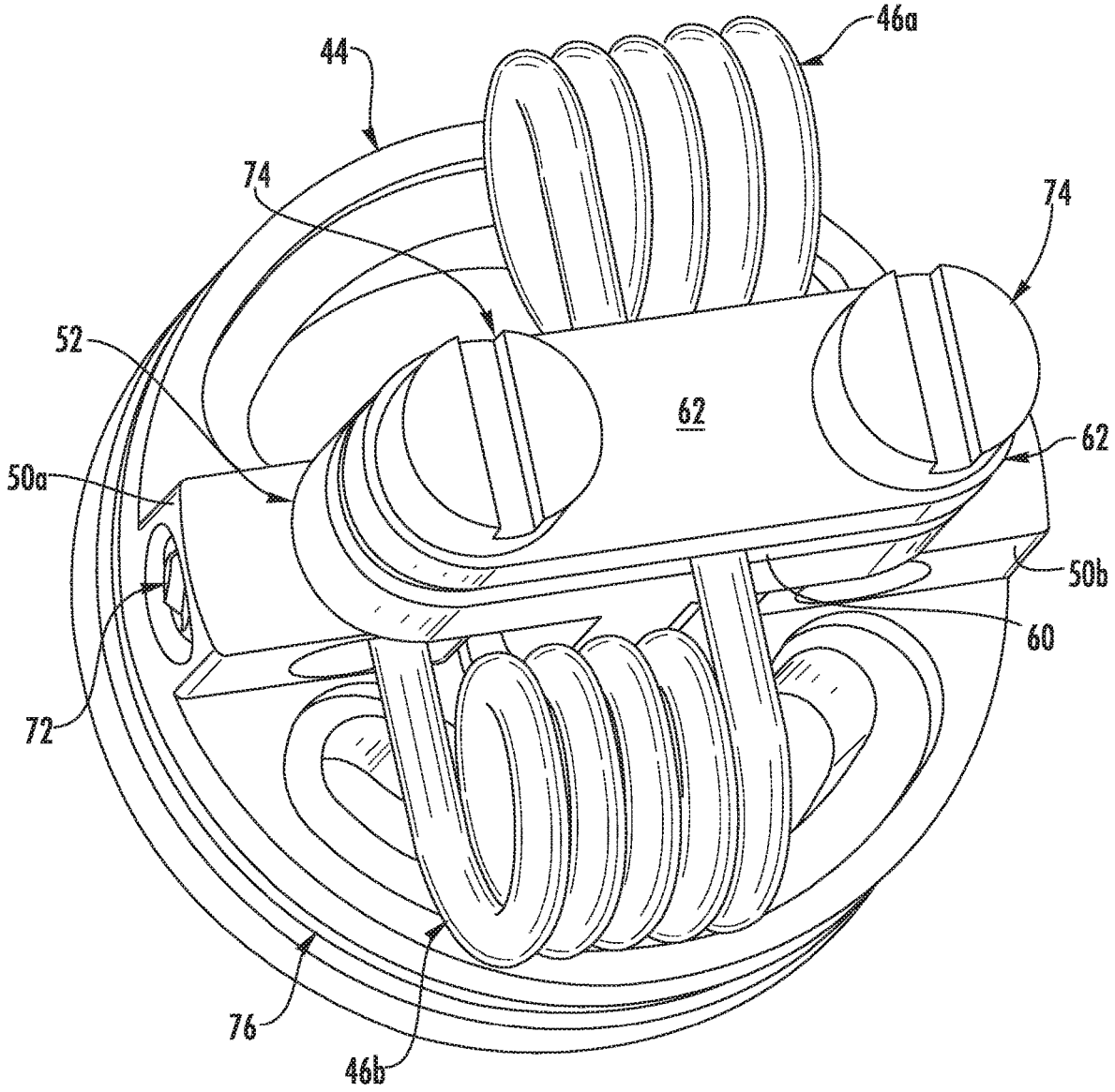
FIG. 15 is an isometric view of the RDA subassembly taken from an angle looking down on the RDA subassembly.

Referring now to FIGS. 9-17, the RDA subassembly 32 includes a cylindrically configured RDA deck 44 formed from a conductive material such as stainless steel, brass, copper, or other metallic material, and supported at the first end 34*a* of the housing 34 and configured to support first and second heating coils 45*a*, 46*b*, each being a single large filament as a heating coil or a number of individual filaments wound together. The heating coils 46*a*, 46*b* are best shown in FIGS. 13-17. The RDA deck 44 includes a central orifice 48 and first and second spaced terminal posts 50*a*, 50*b* configured to connect to first ends 57*a* (FIG. 11) of respective first and second heating coils 46*a*, 46*b* using a mechanical attachment mechanism as explained below. A central column terminal 52, also referred to as a T-column, includes a central post 54 received within the central orifice 48 of the RDA deck 44 that engages the positive pole of a battery 56 held within the housing 34 and a transverse support 58 formed as an upper "T" of the "T-column" carried by the central post 54 and spaced above the terminal posts 50*a*, 50*b* and on which second ends 57*b* (FIG. 11) of respective first and second heating coils 46*a*, 46*b* are positioned such as best shown in FIG. 12 where the ends are positioned on a compression slot 60 formed thereon.

Figure 9:
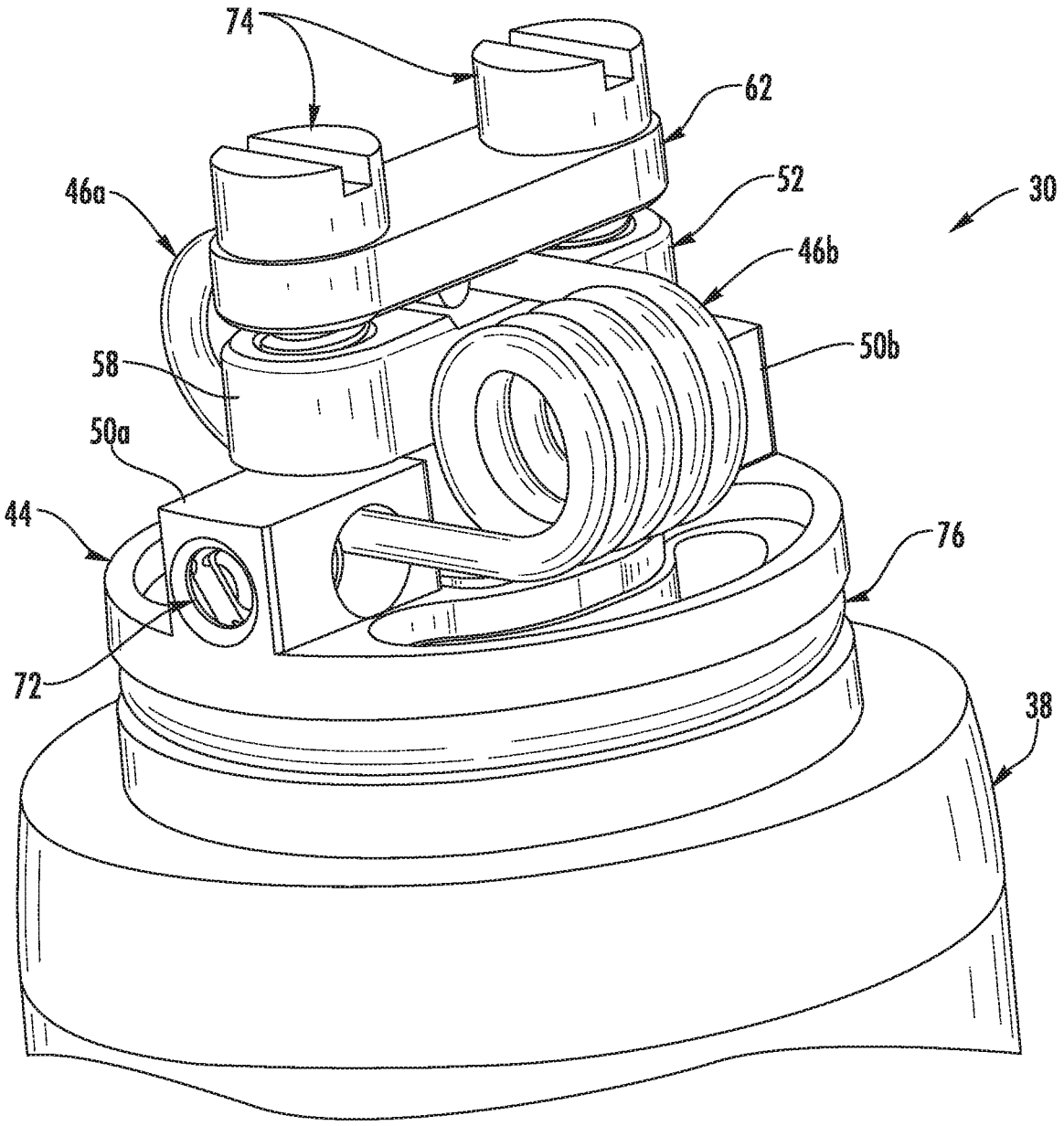
FIG. 9 is a partial, enlarged isometric view of the electronic cigarette and details of the RDA subassembly attached to the female tube.

A clamp bar 62 is secured onto the transverse support 58 and fixes the second ends 57*b* (FIG. 11) of the heating coils 46*a*, 46*b* on the transverse support 58. An insulator 64 in one example is formed as a sleeve (FIG. 10) and is received within the central orifice 48 of the RDA deck 44 and receives the central post 54 and separates and electrically insulates the central post 54 from the RDA deck 44. It is formed from a plastic or other insulator material. As shown in FIGS. 9 and 10, the RDA deck 44 includes a cylindrically configured and recessed well 66 below the terminal posts 50*a*, 50*b* to hold the juice used for vaping, for example. The terminal posts 50*a*, 50*b* are formed on the upper circumferential edge of the RDA deck (FIG. 9) so that the well 66 has a large annular configuration that is deep, and in an example, has an internal stepped configuration as shown in FIG. 10.

The button assembly 40 operates as a switch, and as noted before, is located at the second end 34*b* of the housing, and when closed, the switch completes an electrical circuit from the negative pole of the battery 56 at the second end 34*b* of the housing and through the housing 34 to the RDA deck 44 and energizes the heating coils 46*a*, 46*b* to vaporize the juice contained on at least one wick, and in the illustrated example, the wicks held by the heating coils. The central post 54 includes a contact screw 68 that engages the battery 56, such as the positive terminal at the top of the battery, and is adjustable relative to the battery to ensure electrical contact when the switch is closed. A sleeve ring 70 formed from an insulator material such as plastic encompasses the contact screw 68 to separate and electrically insulate the contact screw from the RDA deck 44. Set screws 72 may secure the first ends of the heating coils 46*a*, 46*b* onto the respective terminal posts 50*a*, 50*b* and clamp screws 74 may secure the clamp bar 62 to the transverse support 58.

Figure 16:
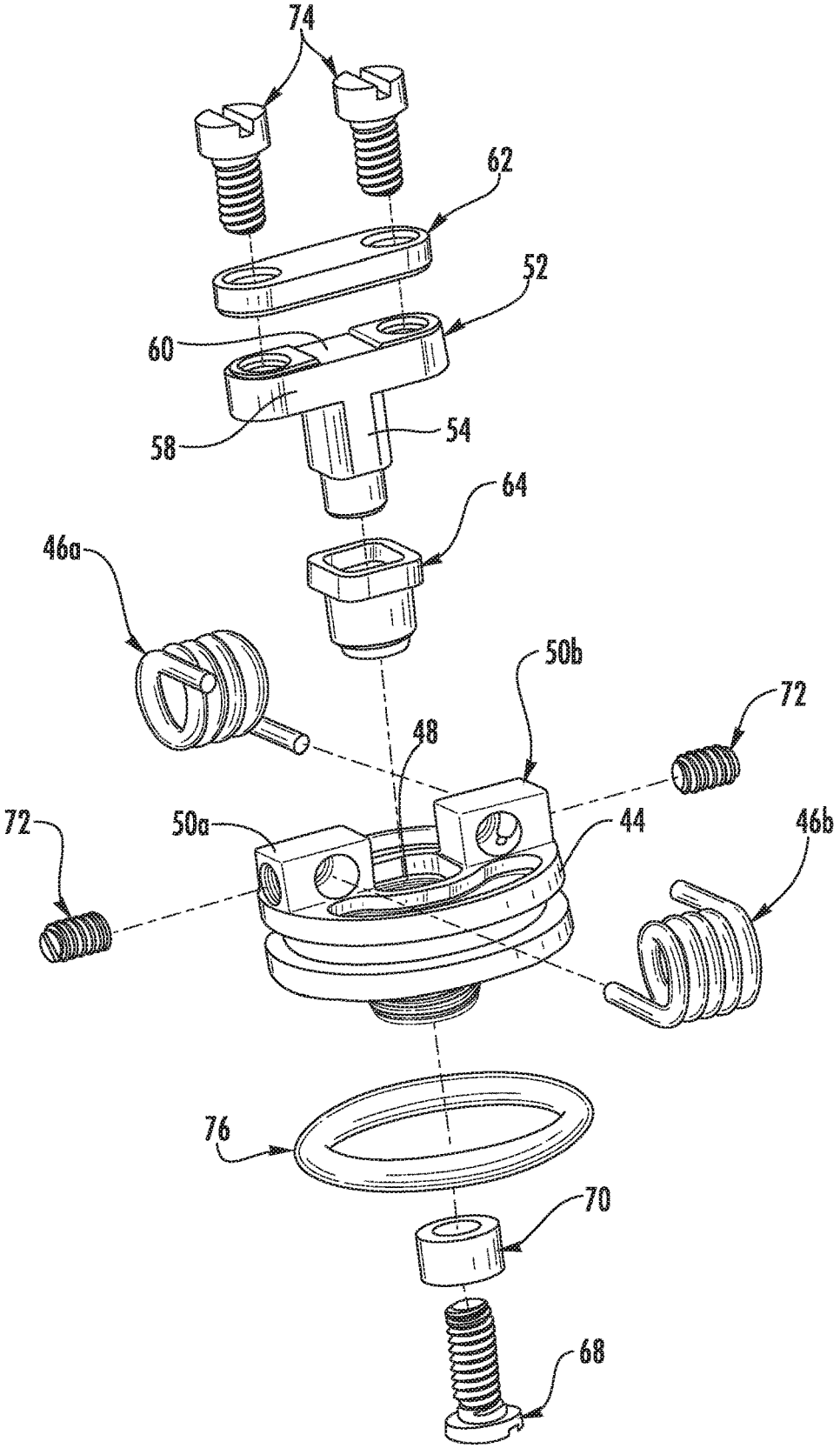
FIG. 16 is an exploded isometric view of the RDA subassembly.

The RDA deck 44 includes an annular outer surface and supports at least one O-ring 76 on the outer surface to retain an RDA cap and a drip tip in an example (not shown) that are received over the RDA deck. The transverse support 58 includes the compression slot 60 as best shown in FIGS. 9, 11, and 16 into which the second ends 57*b* (FIG. 11) of the heating coils 46*a*, 46*b* are received to aid in securing the second ends of the respective first and second heating coils. The heating coils 46*a*, 46*b* are also sometimes referred to as wire filaments by some skilled in the art since the heating coils are small gauge wires. The heating coil may also be formed from a plurality of wire filaments that are wound together. Typically, a heating coil is one gauge and a small diameter of wire or filament that is formed of a material having properties that allow it to heat and vaporize the juice when a current flows through the wire.

The RDA deck 44 is formed from an electrically conductive material such as brass, stainless steel, copper, or other metallic material, and stores a prescribed amount of juice or e-juice as it is sometimes referred as the liquid in the recessed well 66. The RDA deck 44 operates as a base upon which other components of the RDA subassembly 32 attach through various mechanical fastening techniques such as the described set screws 72 and clamp screws 74. The lower portion of the RDA deck 44 includes a mechanical attachment to the female tube 38, the preferred embodiment of which is a male threaded fastener that mates with a female threaded orifice on the top portion or first end 34*a* of the female tube 38 of the housing 34 so that the RDA deck is secured to the housing via the threaded engagement, thereby creating an electrical connection between the RDA deck 44 and the female tube 38 and the overall housing. The RDA deck 44 includes the recessed well 66 as described before that is of a depth sufficient to retain a volume of fluid as the juice for "vaping." The recessed well 66 in one example is annular configured within the RDA deck 44 and positioned below the terminal posts 50*a*, 50*b* and may be of any singular profile or stepped profile as best shown in FIG. 10 where the various shoulder portions forming the stepped profile are configured to any desired depth within the body member forming the RDA deck 44. This profile helps retain the juice and wicking of juice on the wicks. As also shown in the various drawings, the RDA deck 44 may include one or a plurality of recesses or grooves on the outer peripheral surface, such as the illustrated groove formed around the perimeter or outer surface, to receive and retain one or more O-rings 76 that help retain the RDA cap.

In another embodiment, two or more grooves or other receiving recesses in the RDA deck 44 would receive a plurality of O-rings and retain a RDA cap and sometimes drip tip (not shown) over the RDA deck 44 as known to those skilled in the art. The RDA deck 44 includes in this example the electrical terminal posts 50*a*, 50*b* formed above the recessed well 66, on an upper annular top surface or edge surface forming the RDA deck. The two opposing electrical terminal posts 50*a*, 50*b* are of a negative polarity and positioned in-line with the central column terminal 52 as the configured T-column and the clamp bar 62 to connect to first ends 57*a* (FIG. 11) of respective first and second heating coils 46*a*, 46*b*, which could be formed in an example as a number of filaments or a preferred single gauge wire that has sufficient resistance for heating and vaporizing the juice when the electrical circuit is closed.

Figure 17:
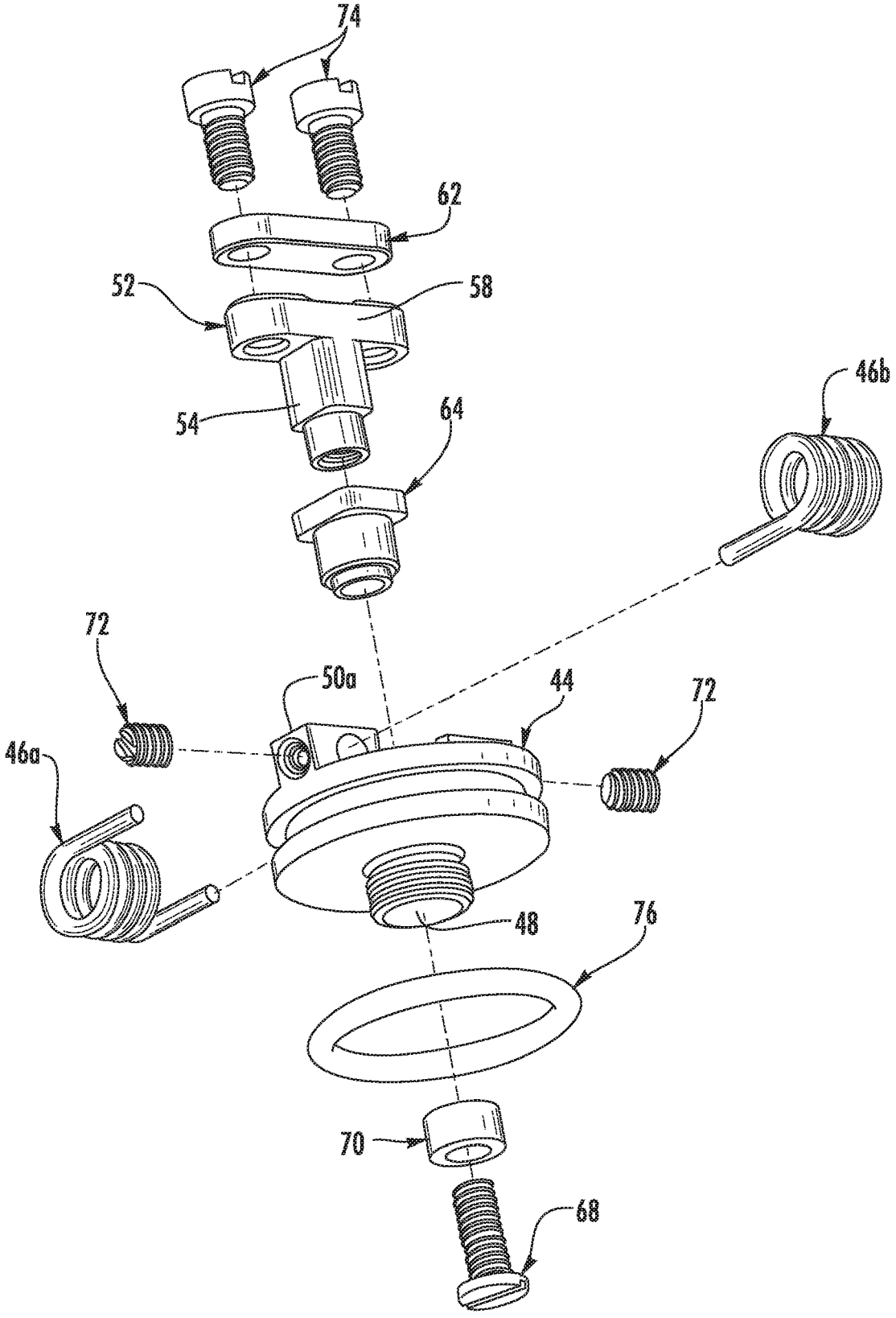
FIG. 17 is yet another exploded isometric view of the RDA subassembly looking from a different angle.

The first and second terminal posts 50*a*, 50*b* may each include a primary smooth bore as a through-hole through which a free end of one or more wire filaments or heating coils 46*a*, 46*b* may be inserted and passed through as illustrated in the drawings. A secondary blind hole as a preferred female threaded fastener blind hole intersects the through-hole that had received the heating coil, and in turn, receives the set screw 72. This blind hole may be oriented at an angle relative to the primary smooth bore as the through-hole that receives the heating coil such that the set screw 72 is screwed in as a mechanical attachment and creates a compressive force upon the free end of the wire filaments or heating coil against the respective terminal post 50*a*, 50*b*, thereby creating an electrical connection between the RDA deck 44 and the one or more wire filaments or heating coil. The RDA deck 44 includes the central orifice 48 as a through-hole of varying cross-sections through which the central post 54 of the central column terminal 52 as the T-column is received. It also receives the sleeve 64, the sleeve ring 70, and contact screw 68 that are assembled together (FIGS. 16 and 17). The central orifice 48 as a through-hole of the RDA deck 44 preferably includes a plurality of stepped shoulders (shown in FIGS. 10 and 11) forming a stepped configuration upon which the compressive forces imposed by the mechanical arrangement of the sleeve 64, sleeve ring 70, central post 54 of the central column terminal 52 and contact screw 68 may be applied to aid in retaining those components together.

The at least one O-ring 76 may be formed from an easily compressible and elastic material and serve to create an air-tight seal between the RDA cap and drip tip (not shown) that are commonly used in the art and operate as an assembly technique between the RDA deck 44 and the common RDA cap via a compression fit interaction. The at least one O-ring 76 is received along the groove or other recess that extends along the outer peripheral surface of the RDA deck 44 and is held in place by the contours of the groove and the tensile elastic deformation of the O-ring.

The sleeve 64 is an insulator as described above is formed from an electrically insulating material and could be formed from one or more components. It serves as an electrical insulator to ensure no physical contact is made between the central column terminal 52 and the contact screw 68 and the RDA deck 44. In one example, it encompasses all or portions of the central post 54 and portions of the contact screw 68 that would otherwise make physical and electrical contact with the RDA deck. The bottom of the sleeve 64 on both the inside and on its orifice may include a shoulder or other stepped portion forming a profile to engage a stepped portion of the RDA deck central orifice 48 and a stepped portion of the central post as best shown in FIGS. 10 and 11. The sleeve 64 is inserted through the through-hole, i.e., central orifice 48 of the RDA deck from above. The sleeve 64 includes a through-hole of varying cross-sections through which the central post 54 and contact screw 68 are inserted and assembled via a mechanical technique. The sleeve 64 as noted before includes a plurality of shoulders or other stepped profile features both internally and externally upon which the compressive forces of the mechanical assembly of the RDA deck 44, sleeve ring 70, central column terminal 52, and contact screw 68 are applied.

The sleeve ring 70 could be formed from one or more components and is formed from an electrically insulating material. The sleeve ring 70 serves as an electrical insulator to ensure no physical contact is made between the contact screw 68 and components of the RDA deck 44 by encompassing all or portions of the contact screw 68. The sleeve ring 70 is inserted through the through-hole as the central orifice 48 of the RDA deck 44 from below. The sleeve ring 70 may include a through-hole of varying cross-section through which the contact screw 68 is inserted and assembled by mechanical fasteners to the central post 54, the RDA deck 44, and sleeve 64. In one example, the sleeve 64 may include a plurality of shoulder features having a stepped configuration, internally and externally, upon which the compressive forces of the mechanical assembly of the RDA deck 44, sleeve 64, central column terminal 52, and contact screw 68 apply.

The contact screw 68 is also made from an electrically conductive material and could be formed by one or more components along with the other conductive components, to transmit electrical energy from the battery terminal as the positive terminal in this case to the heating coils 46*a*, 46*b*. The contact screw 68 is inserted into the through-hole of the sleeve ring 70 and the combination of the two then inserted into the through-hole as the central orifice 48 of the RDA deck 44 from below and then further assembled by mechanical attachment to the central post 54 and sleeve 64. The contact screw 68 serves as one of the two electrical contacts for the battery 56 and maintains a constant electrical connection with the battery when the apparatus as the electronic cigarette is fully assembled.

The clamp screws 74 are also made from an electrically conductive material to affix the clamp bar 62 to the transverse support 58 as the top "T" of the central column terminal 52, also termed the T-column, via a mechanical attachment using the clamp screws 74 in a preferred embodiment, which simultaneously apply compressive forces between the clamp bar and the central column terminal such that force is applied to the free second ends 57*b* (FIG. 11) of the heating coils 46*a*, 46*b*, thereby retaining and affixing free ends of the wire filament or heating coil in place. This creates an electrical connection between the central column terminal 52 and clamp bar 62 and heating coils 46*a*, 46*b*. The clamp bar 62 is one component in a series of components used to transmit electrical energy from the battery terminal to the wire filaments or heating coil.

The central column terminal 52 that is also referred to as the T-column is formed from a conductive material such as stainless steel, brass, copper, or other metallic or conductive material, and used as an intermediary component to transmit the electrical energy of the battery to the heating coils 46*a*, 46*b* while insulated against electrical contact with the RDA deck 44 via the sleeve 64. The central post 54 of the central column terminal 52 or "T-terminal" is inserted into the sleeve 64 to separate and electrically insulate the central column terminal as the T-column and the RDA deck 44. It is affixed to the RDA deck 44 via mechanical attachment of the contact screw 68 that creates compressive forces on the shoulders formed on the RDA deck, sleeve and sleeve ring as best shown in FIGS. 10 and 11. By using the mechanical attachment as described above for the contact screw 68 and central column terminal 52, an electrical connection is made between the battery terminal, contact screw 68, and central column terminal 52.

Additionally, by using the compressive forces that are exerted against the clamp bar 62 via the clamp screws 74 as a mechanical attachment to the central column terminal 52 as the T-column to retain and affix one of the free ends of the wire filaments or heating coil, an electrical connection is thus created between the central column terminal and clamp bar and the heating coils 46*a*, 46*b*.

The heating coils 46*a*, 46*b* may be formed from multiple strands of wire filaments or one wire as a single gauge forming a heating coil as a single strand, and of course, from an electrically conductive material that has the properties and resistance to heat up when the switch is closed and atomize fluid on a wick. The physical connection is made at either free end to create an electrical connection where the electrical energy is passed through the heating coils upon activation of the device as an electronic cigarette by the user. This can occur in one example by depressing their pinky finger against the lower end of the switch 40 as a button assembly that in an example is positioned at the second end of the housing and explained above. In some embodiments, the switch may be attached onto the housing itself at the peripheral side along the cylindrical surface and actuated by the thumb. The natural electrical resistance of the wire filament as a heating coil, in an example, generates heat sufficient to vaporize a prescribed liquid substance such as the juice contained on a wick, in one example, and contained in the recessed well 66. Different flavors of juice may be used and different types of juice. The heating coils 46*a*, 46*b* have one free end affixed to the RDA deck 44 via its electrical terminal posts 50*a*, 50*b* and the mechanical attachment via the set screws 72. The opposing free end is affixed to the transverse support 58 of the central column terminal as the T-column and by the clamp bar via the assembled compressive forces.

The set screws 72 may be made of an electrically conductive material and aid in creating an electrical connection between the free end of the heating coils 46*a*, 46*b* and the electrical terminal posts of the RDA deck. This is accomplished by passing the free end of the heating coils 46*a*, 46*b* through or within the through-hole of the electrical terminal first and second posts 50*a*, 50*b* and using a mechanical attachment via the set screws into the electrical terminal post blind holes, which intersect the through-holes, to compress, retain and affix the free ends of the heating coils.

The battery 56 serves as a source of stored electrical energy to power the device as the electronic cigarette 30. The battery 56 can be any form that can be held within the cylindrical housing 34 formed from the female tube 38 and male tube 36.

The male-female tube subassembly forming the housing 34 includes the female tube 38, which is made from an electrically conductive material as noted before and uses a housing or storage for the battery 56 as shown in FIG. 5 and as an intermediate component to transfer the electrical energy of the battery from one terminal of the battery to the switch 40 or button assembly forming the bottom housing button subassembly and through the male and female tubes 36, 38 to the RDA subassembly 32 where it ultimately flows back to the opposing terminal of the battery. The female tube 38 uses mechanical attachment techniques to attach to the RDA deck 44 of the RDA subassembly 32, the preferred embodiment of which is a female threaded fastener. The female tube may have the plurality of through-holes 42 on any portion of its length of any size or shape that can be configured to give a unique design and permit the otherwise obscured portion of the male tube to be seen and give a further decorative ornamental effect by allowing the surface of the male tube to be exposed.

The male tube 36 is also made from an electrically conductive material and used as a housing for the battery and as an intermediate component to transfer the electrical energy of the battery from one terminal of the battery to the switch 40 as the button assembly and to the female and male tubes to the RDA subassembly 32 where the current flows back to the opposing terminal of the battery 56. The male tube 36 uses a mechanical attachment as threads in this example to attach the button assembly 40 to its lower end, the preferred embodiment which is a female threaded fastener shown in FIGS. 1-4. The male tube 36 mechanically attaches to the female tube 38, the preferred embodiment of which is a male threaded fastener. The male tube 36 inserts within the volume of the female tube 38 as best shown in FIG. 5, which partially or wholly obscures a portion of the male tube's length, depending on the geometry of the female tube.

The button assembly 40, also referred to as the bottom housing button subassembly, operates as a switch sufficient to open and close an electrical circuit, acting as a normally open electrical switch between the positive terminal of the battery 56 and its opposing negative terminal as explained above. The button assembly 40 mechanically attaches by threading into the male tube 36 and an electrical connection is created that allows electrical energy of the battery 56 to flow through the tube and establish an electrical circuit. The user of the electronic cigarette as the apparatus may depress using their finger, such as their pinky, the button assembly 40 to selectively open or close the electrical switch, thereby activating or deactivating the apparatus as the electronic cigarette. A standard design as a one-piece button is illustrated, such as in FIG. 5, and includes a pin or firing pin mechanism, but could be a three-piece button assembly, such as shown and explained below with reference to FIGS. 18A through 20G.

One advantage of positioning the terminal posts 50*a*, 50*b* in line with the central column terminal 52 and clamp bar 62 is that it creates an arrangement where one free end of the heating coils 46*a*, 46*b* may be inserted into either of the electrical terminal posts, at the discretion of the user, and the opposing free end of the heating coils may be simultaneously inserted into the compression slot 60 formed on the top of the transverse support 58, thereby reducing the difficulty of assembly. Another advantage of this preferred embodiment's arrangement is that all of the electrical connection features are positioned above the recessed well 66, thereby maximizing the available volume of fluid storage within the recessed well.

An advantage of having the male tube 36 inserted within the female tube 38 is that a wide variety of ornamental features in the form of through-holes can be added to the body of the female tube, which then will expose the male tube's otherwise obscured portions for ornamental or decorative effects. This combination of the features between the male and female tubes 36, 38 creates a secondary layer for the otherwise obscured portions of the male tube, upon which ornamental features or colors may be added to provide a higher level of decorative aesthetic when compared to other devices.

In an example, the RDA deck 44 may be 22 mm and include 2.5 mm post holes to fit all popular gauges of wire. It can include titanium screws and has an easy building area. The terminal posts can be milled to the deck to cut down on spinning or breaking. The positive center has a keyed bottom to prevent spinning. The titanium screws add to an aesthetic appeal. A battery may be added to the housing by unscrewing the button housing 40 and inserting a battery. An example could be a high drain 40 amp battery with the positive end in first. The firing pin or button 40*b* may be adjustable such as formed as a screw.

Different types of heating coils "vape wires" may be used, including Kanthal (FeCrAl), Nichrome, stainless steel, nickel, and titanium. Stainless steel is considered by many to be the most versatile. Different grades of stainless steel wire may be used. The most popular gauges for the wire are 32, 30, 28, 26, 24, and 22. The type of wicking material can vary and could include organic cotton, Japanese cotton pads, ekowool, silica, and rayon fiber.

Figure 18A:
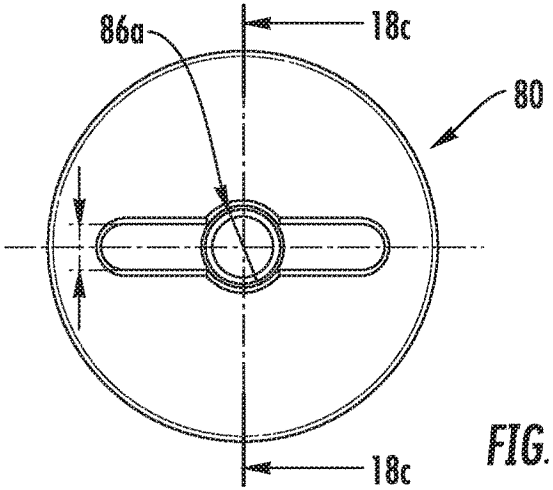
FIG. 18A is a top plan view of the base member as part of the three-piece button assembly.
Figure 18B:
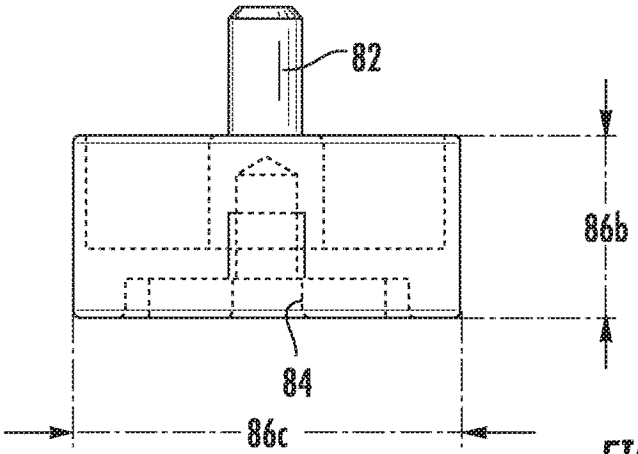
FIG. 18B is a side elevation view of the base member.
Figure 18C:
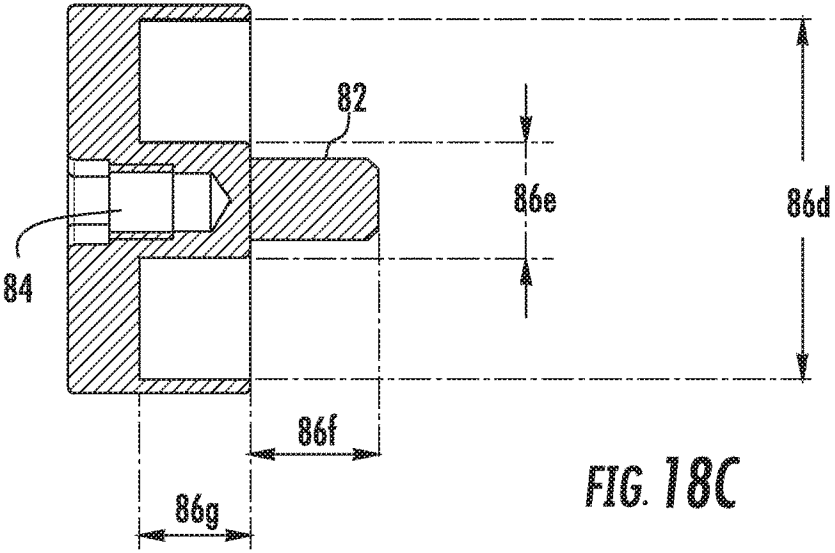
FIG. 18C is a sectional view of the base member taken along line 18C-18C of FIG. 18A.
Figure 18D:
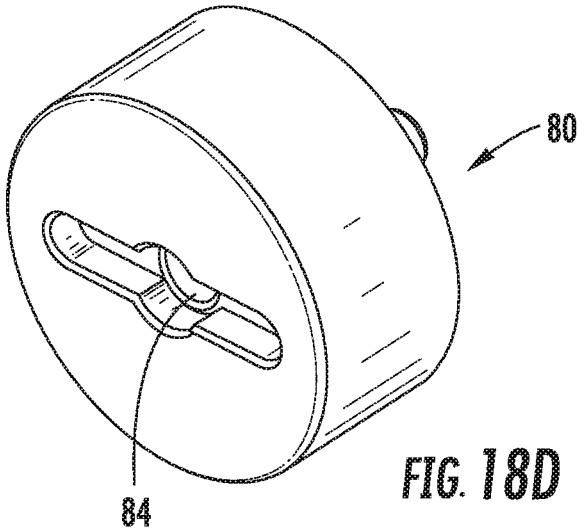
FIG. 18D is an isometric view looking toward the top portion of the base member.
Figure 18E:
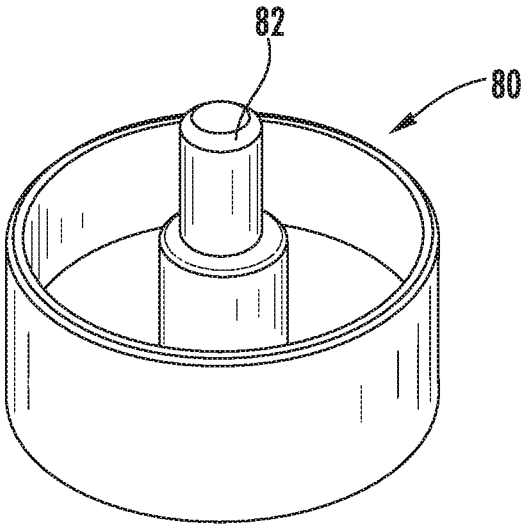
FIG. 18E is an isometric view of the base member looking downward at the threaded extension.

As noted before, FIGS. 18A through 20G illustrate components of a three-piece button assembly that could operate with the firing pin mechanism as described above. FIGS. 18A through 18E show the base member 80 of the three-piece button assembly where the base member has a threaded extension 82 adapted to cooperate with a firing pin mechanism, and it includes a threaded orifice 84. Dimensions of various parts can vary, but in an example, the thread depth shown in FIG. 18A and indicated generally at 86*a* may have a M4×0.7 and 0.220 inch minimum thread depth. The threaded extension 82 or shaft that cooperates with the firing pin mechanism in an example may have a M4×0.7 thread and it should be test fit with the firing pin before it is fully bottomed out. The dimension 86*b* (FIG. 18B) for the height of the base member could be about 0.384 inches and with an option 1 such as use with the button screw member shown in FIGS. 20C and 20D could be about 0.399 inches. The diameter as shown by dimension 86*c* could be about 0.823 inches. In the sectional view shown in FIG. 18C, the dimension could be about 0.764 inches 86*d*, and dimension 86*e* could be about 0.244 inches. The thread extension as dimension 86*f* could be about 0.276 inches, and dimension 86*g* could be about 0.240 inches. The isometric view shown in FIGS. 18D and 18E show a configuration for the base member. When it is test fit with the button screw member, it must fully bottom out.

Referring now to FIGS. 19A through 19F, there is illustrated the intermediate ring member 90 that is interposed between the base member 80 and a button screw member 100 shown in FIGS. 20A through 20G. The ring member includes a slot 92 extending partially through the intermediate ring member and followed by through-hole 94. The slot 92 has a configuration to match and receive the head 102 of the button screw member 100. Representative dimensions such as 96*a* for the diameter could be about 0.250 inches, and dimension 96*b* as a diameter of about 0.820 inches.

Figure 19A:
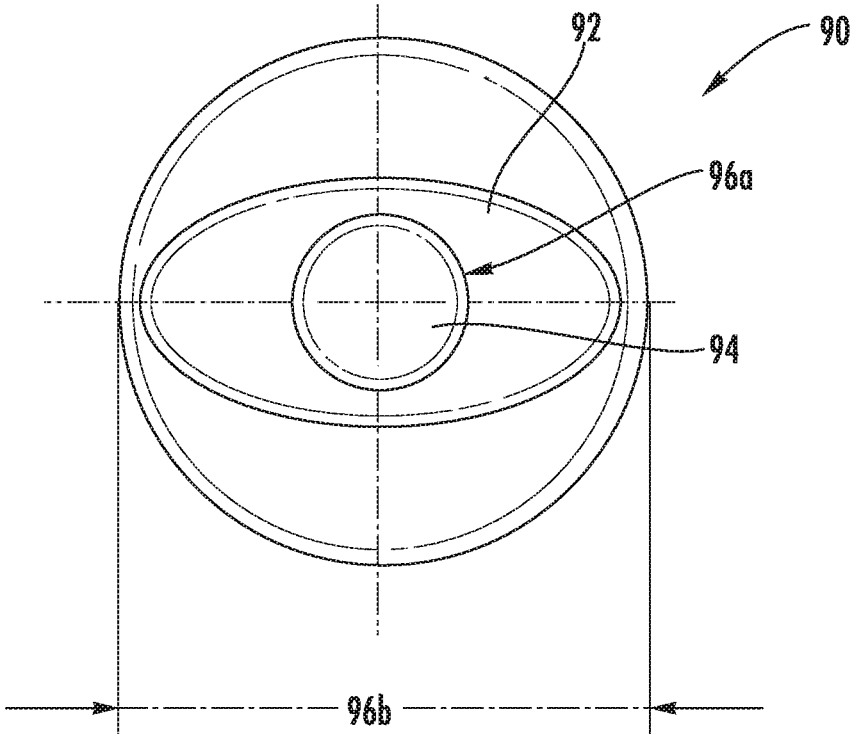
FIG. 19A is a top plan view of the intermediate ring member as part of the three-piece button assembly and having an oval configured slot.
Figure 19B:
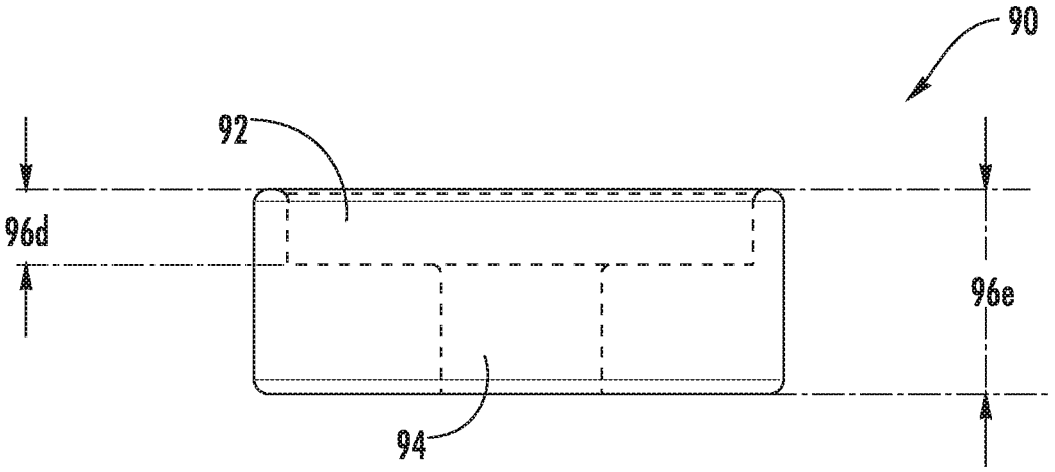
FIG. 19B is a side elevation view of the intermediate ring member of FIG. 19A.
Figure 19C:
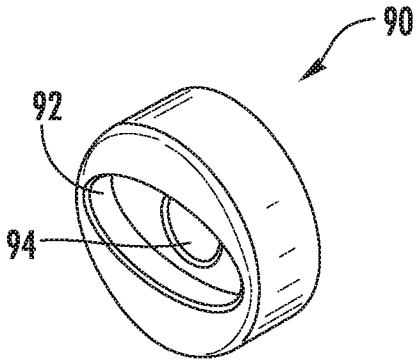
FIG. 19C is an isometric view of the intermediate ring member shown in FIG. 19A.
Figure 19D:
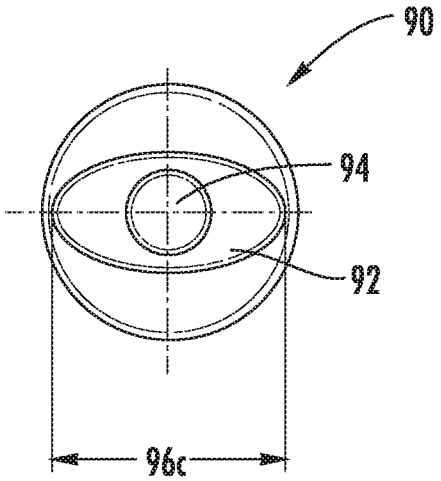
FIG. 19D is another plan view of the intermediate ring member shown in FIG. 19A.
Figure 19E:
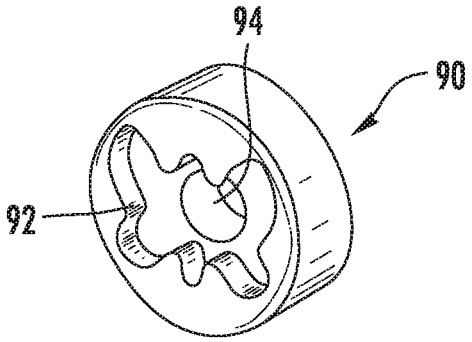
FIG. 19E is an isometric view of the intermediate ring member having a slot configured as a moth.
Figure 19F:
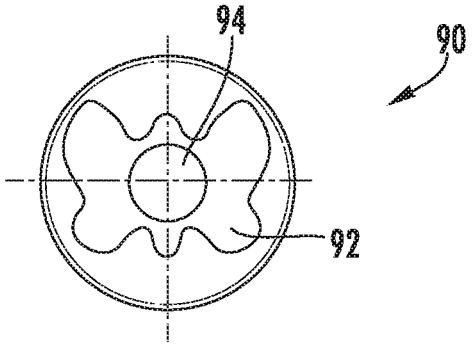
FIG. 19F is a top plan view of the intermediate base member shown in FIG. 19E.

FIGS. 19C and 19D show the oval configuration such as shown in FIGS. 19A and 19B, where the slot is oval and has a length of about 0.725 inches as dimension 96*c*. In FIG. 19B, the depth of the slot may be about 0.120 inches (96*d*) and the height of the intermediate ring member could be about 0.320 inches (96*e*). A configuration showing a moth configured slot for the intermediate ring member is shown in FIGS. 19E and 19F.

Figure 20A:
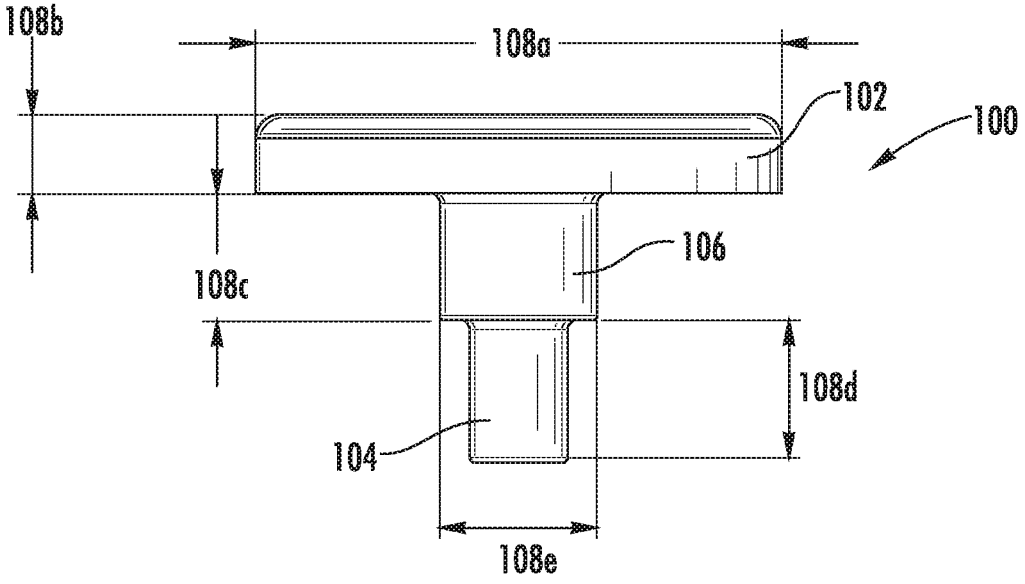
FIG. 20A is a front elevation view of the button screw member as part of the three-piece button assembly.
Figure 20B:
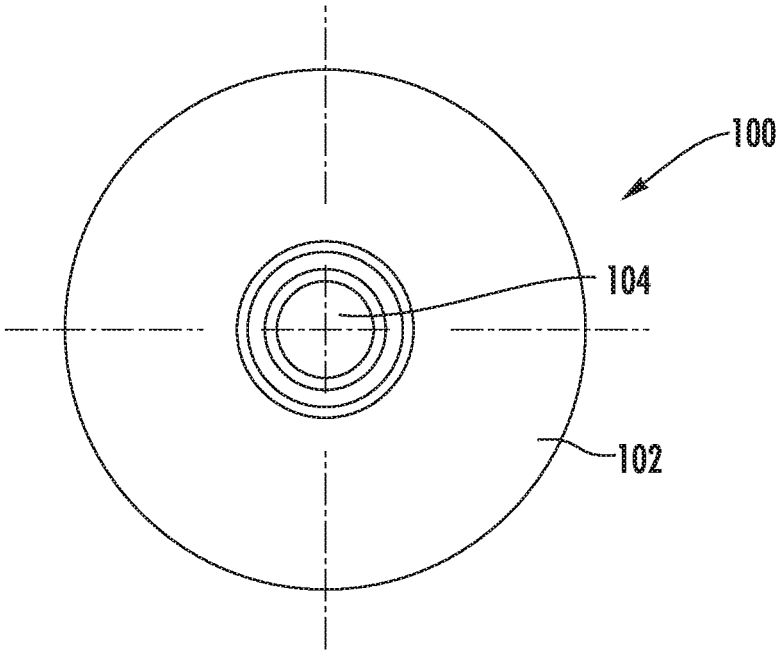
FIG. 20B is a top plan view of the button screw member.
Figure 20C:
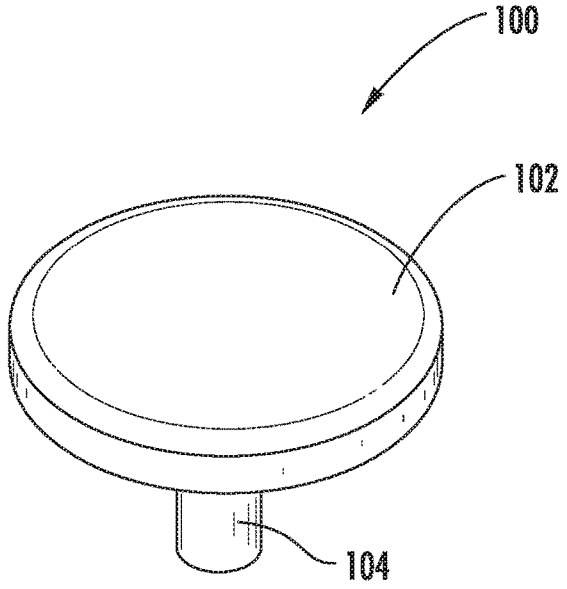
FIGS. 20C and 20D are isometric views of the button screw member having a blank configuration.
Figure 20D:
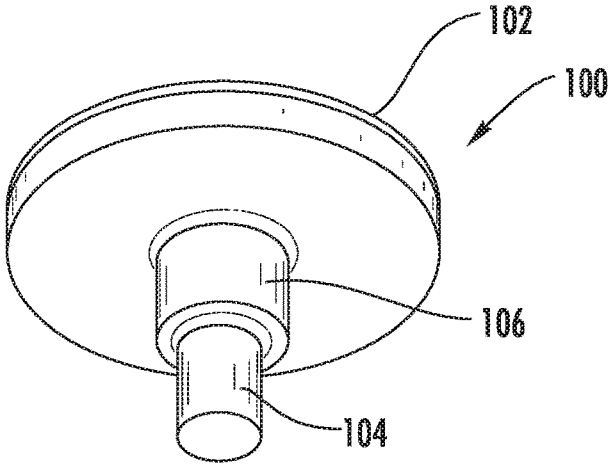
Figure 20E:
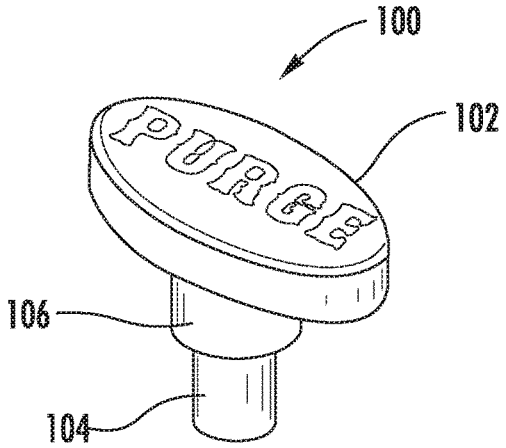
FIGS. 20E and 20F are isometric views of the button screw member that cooperates with the intermediate ring member shown in FIGS. 19A through 19D.
Figure 20F:
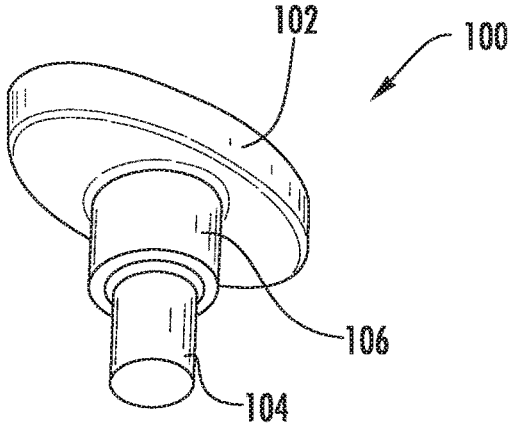
Figure 20G:
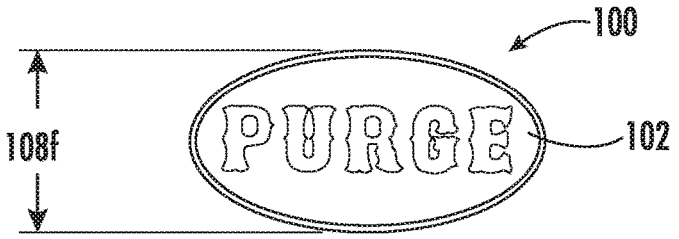
FIG. 20G is a top plan view of the button screw member shown in FIGS. 20E and 20F.

Referring now to FIGS. 20A through 20G, there is shown an embodiment of the button screw member 100 that includes the head 102 having a predetermined configuration such as the oval shown in FIGS. 20E, 20F, and 20G, and a threaded shaft 104 extending therefrom and supported on a central hub support 106. The threaded shaft 104 is received into the threaded orifice 84 in the base member 80. The threaded shaft 104 or extension as it may be called may include an M4×0.7 thread with dimensions varying such as at 108*a* as 0.822 inches in diameter, 108*b* as 0.125 inches, 108*c* as 0.200 inches, 108*d* as 0.225 inches, and 108*e* as 0.245 inches. The head 102 may include engravings such as shown in FIG. 20E and have a polished metal finish and have a dimension of about 0.365 inches (108*f*).

In an example, the base member and button screw member are formed of a metallic material that could be as an example stainless steel, brass, or copper. The intermediate ring member could be formed from a plastic material and may have decorative features. In an example, plastic materials could include polyetherimide as an amber-to-transparent solid often used with 3D printers and also referred to by the tradename Ultem and have heat resistance, solvent resistance and flame resistance, and a high dielectric strength. Another material could be Delrin as polyoxymethylene also referred to as Celcon and by other tradenames. It has high strength, hardness and rigidity, and is available in different colors. Acrylic could be used. Many other plastics could be used. For all components, normal manufacturing tolerances typically may apply.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An electronic cigarette, comprising:

a housing configured to hold a battery;

a rebuildable dripping atomizer (RDA) deck formed of a conductive material and supported by said housing and having a central orifice and first and second spaced terminal posts configured to connect to first ends of respective first and second heating coils;

a central column terminal comprising a central post received within the central orifice of the RDA deck that engages the battery, and a transverse support carried by the central post and spaced above the terminal posts onto which second ends of respective first and second heating coils are positioned;

a clamp bar secured onto the transverse support and fixing the second ends of the heating coils in place on the transverse support;

an insulator received within the central orifice of the RDA deck and insulating electrically the central post from the RDA deck;

an electrical circuit connecting the battery and RDA deck; and a switch carried by the housing and connected to the electrical circuit, wherein when closed, said switch completes the electrical circuit and energizes the heating coils to vaporize juice contained on at least one wick held by the heating coils.

2. The electronic cigarette according to claim 1, wherein said RDA deck further comprises a recessed well to hold juice.

3. The electronic cigarette according to claim 1, wherein said central post further comprises a contact screw that engages the battery and is adjustable relative to the RDA deck and battery to ensure electrical contact.

4. The electronic cigarette according to claim 1, comprising a sleeve ring into which the contact screw is received to insulate electrically the contact screw from the RDA deck.

5. The electronic cigarette according to claim 1, wherein said first and second spaced terminal posts are negative in polarity and said central column terminal is positive in polarity.

6. The electronic cigarette according to claim 1, further comprising set screws configured to secure the first ends of the heating coils onto the respective terminal posts and clamp screws configured to secure the clamp bar to the transverse support.

7. The electronic cigarette according to claim 1, wherein said housing is cylindrically configured and includes first and second ends, wherein said RDA deck is supported at the first end and said switch is supported at the second end.

8. The electronic cigarette according to claim 1, wherein said switch comprises a button assembly having a button and firing pin mechanism for completing the electrical circuit when the button is depressed.

9. The electronic cigarette according to claim 8, wherein said button assembly further comprises:

a base member having a threaded extension adapted to cooperate with a firing pin mechanism and a threaded orifice;

a button screw member comprising a head having a predetermined configuration and threaded shaft extending therefrom and received into the threaded orifice in the base member; and an intermediate ring member interposed between the base member and the button screw member and including a slot having a configuration to match and receive the head of the button screw member.

10. The electronic cigarette according to claim 9, wherein said base member and button screw member are formed of a metallic material and the intermediate ring member is formed from a plastic material.

11. The electronic cigarette according to claim 1, wherein said housing comprises a female tube and male tube received therein.

12. The electronic cigarette according to claim 11, wherein the female tube has holes that are configured to expose portions of the male tube received therein.

13. The electronic cigarette according to claim 1, wherein the RDA deck is cylindrically configured and has an outer surface and includes at least one O-ring supported on the outer surface to retain a RDA cap and drip tip received over the RDA deck.

14. The electronic cigarette according to claim 1, wherein said transverse support includes a compression slot into which the second ends of the heating coils are received.

15. An electronic cigarette, comprising:

a housing comprising a metallic tube and having a first closed end and a second end and configured to hold a battery having a positive pole adjacent the first end of the housing and a negative pole adjacent the second end of the housing;

a metallic rebuildable dripping atomizer (RDA) deck supported at the first closed end of the housing and configured to support first and second heating coils and having a central orifice and first and second spaced terminal posts configured to connect to first ends of respective first and second heating coils;

a central column terminal comprising a central post received within the central orifice of the RDA deck that engages the positive pole of the battery held within the housing, and a transverse support carried by the central post and spaced above the terminal posts onto which second ends of respective first and second heating coils are positioned;

a clamp bar secured onto the transverse support and fixing the second ends of the heating coils in place on the transverse support;

a sleeve formed of an insulator material and received within the central orifice of the RDA deck and having an orifice that receives the central post and electrically insulates the central post from the RDA deck; and a switch at the second end of the housing, wherein when closed, said switch completes an electrical circuit from the negative pole of the battery through the housing to the RDA deck and energizes the heating coils to vaporize juice contained on at least one wick held by the heating coils, said switch further comprising a button assembly having a button and firing pin mechanism for completing the electrical circuit when the button is depressed.

16. The electronic cigarette according to claim 15, wherein said RDA deck further comprises a cylindrically configured recessed well to hold juice.

17. The electronic cigarette according to claim 15, wherein said central post further comprises a contact screw that engages the battery and is adjustable relative to the battery to ensure electrical contact.

18. The electronic cigarette according to claim 17, comprising a sleeve ring encompassing the contact screw to insulate electrically the contact screw from the RDA deck.

19. The electronic cigarette according to claim 15, further comprising set screws configured to secure the first ends of the coils onto the respective terminal posts and clamp screws configured to secure the clamp bar to the transverse support.

20. The electronic cigarette according to claim 15, wherein said housing comprises a male and female tube.

21. The electronic cigarette according to claim 19, wherein said female tube has holes that are configured to expose portions of the male tube.

22. The electronic cigarette according to claim 15, wherein the RDA deck has an outer surface and includes at least one O-ring supported on the outer surface to retain a RDA cap and drip tip received over the RDA deck.

23. The electronic cigarette according to claim 15, wherein said transverse support includes a compression slot into which the second ends of the heating coils are received.

24. The electronic cigarette according to claim 15, wherein said button assembly further comprises:

a base member having a threaded extension adapted to cooperate with a firing pin mechanism and a threaded orifice;

a button screw member comprising a head having a predetermined configuration and threaded shaft extending therefrom and received into the threaded orifice in the base member; and an intermediate ring member interposed between the base member and the button screw member and including a slot having a configuration to match and receive the head of the button screw member.

25. The electronic cigarette according to claim 24, wherein said base member and button screw member are formed of a metallic material and the intermediate ring member is formed from a plastic material.

26. A rebuildable dripping atomizer (RDA) apparatus, comprising:

a metallic RDA deck having a threaded protrusion configured to connect to a housing of an electronic cigarette and wherein said RDA deck has a central orifice and first and second spaced terminal posts configured to connect to first ends of respective first and second heating coils and a cylindrically configured, recessed well to hold juice;

a central column terminal comprising a central post received within the central orifice of the RDA deck and configured to engage a battery held within the housing to which the RDA deck is connected, and a transverse support carried by the central post and spaced above the terminal posts onto which second ends of respective first and second heating coils are positioned;

a clamp bar secured onto the transverse support and fixing the second ends of the heating coils in place on the transverse support; and a sleeve formed of an insulator material and received within the central orifice of the RDA deck and having an orifice that receives the central post and electrically insulates the central post from the RDA deck.

27. The RDA apparatus according to claim 26, wherein said central post further comprises a contact screw that is configured to engage a battery held within a housing that is connected to the RDA deck and is adjustable relative to ensure electrical contact.

28. The RDA apparatus according to claim 26, comprising a sleeve ring encompassing the contact screw to insulate electrically the contact screw from the RDA deck.

* * * * *